US011866901B2

(12) United States Patent
Curson et al.

(10) Patent No.: US 11,866,901 B2
(45) Date of Patent: Jan. 9, 2024

(54) HORIZONTAL MECHANICALLY STABILIZING GEOGRID WITH IMPROVED GEOTECHNICAL INTERACTION

(71) Applicant: Tensar International Corporation, Alpharetta, GA (US)

(72) Inventors: Andrew Curson, Burnley (GB); Tom Ross Jenkins, Baildon (GB); Andrew Edward Waller, Newton-le-Willows (GB); Daniel John Gallagher, Adlington (GB); Daniel Mark Baker, Broomfield, CO (US); Manoj Kumar Tyagi, Fayetteville, GA (US); Joseph Cavanaugh, Cumming, GA (US)

(73) Assignee: Tensar International Corporation, Alpharetta, GA (US)

( * ) Notice: Subject to any disclaimer, the term of this patent is extended or adjusted under 35 U.S.C. 154(b) by 0 days.

(21) Appl. No.: 18/075,862

(22) Filed: Dec. 6, 2022

(65) Prior Publication Data

US 2023/0104474 A1 Apr. 6, 2023

Related U.S. Application Data

(63) Continuation of application No. 17/557,474, filed on Dec. 21, 2021, now Pat. No. 11,519,150, which is a (Continued)

(51) Int. Cl.
*E02D 17/20* (2006.01)
*E02D 3/00* (2006.01)

(52) U.S. Cl.
CPC ..... *E02D 17/202* (2013.01); *E02D 3/00* (2013.01); *E02D 2300/0084* (2013.01)

(58) Field of Classification Search
CPC .. E02D 17/202; E02D 2300/0084; E02D 3/00
See application file for complete search history.

(56) References Cited

U.S. PATENT DOCUMENTS 3,252,181 A 5/1966 Hureau
3,317,951 A 5/1967 Hureau
(Continued)

FOREIGN PATENT DOCUMENTS

CN 201411677 2/2010
CN 201826440 5/2011
(Continued)

OTHER PUBLICATIONS

Das, Braja, M. Use of geogrid in the construction of railroads. Innov. Infrastruc. Solut. (2016) 1:15, published Jun. 28, 2016.
(Continued)

*Primary Examiner* — Sean D Andrish
(74) *Attorney, Agent, or Firm* — E. Eric Mills; Bryan L. Baysinger; Maynard Nexsen PC

(57) ABSTRACT

Aspects of a geogrid system and method for improving substrate interactions within a geotechnical environment is disclosed. In one aspect a geotechnical environment is configured with a horizontal multilayer mechanically stabilizing geogrid. In said aspect the geogrid is extruded with a polymeric material and a compressible cellular layer, wherein the geogrid comprises a heightened aspect ratio with a patterned structure of engineered discontinuities and a plurality of strong axes. The combination of elements provides for a system and method of stabilizing soils and aggregate, by resisting lateral movement from the strong axes, and trapping particles in the patterned structure of engineered discontinuities.

17 Claims, 30 Drawing Sheets

Related U.S. Application Data continuation-in-part of application No. PCT/US2021/038863, filed on Jun. 24, 2021, and a continuation-in-part of application No. 17/355,843, filed on Jun. 23, 2021, now Pat. No. 11,390,015.

(60) Provisional application No. 63/154,588, filed on Feb. 26, 2021, provisional application No. 63/154,209, filed on Feb. 26, 2021, provisional application No. 63/043,627, filed on Jun. 24, 2020.

(56) References Cited

U.S. PATENT DOCUMENTS

| | | | | |
|---|---|---|---|---|
| 3,496,965 | A | 2/1970 | Hureau | |
| 4,374,798 | A | 2/1983 | Mercer | |
| 4,470,942 | A | 9/1984 | Beretta | |
| 4,590,029 | A | 5/1986 | Mercer | |
| 4,743,486 | A | 5/1988 | Mercer et al. | |
| 4,756,946 | A | 7/1988 | Mercer | |
| 4,808,358 | A | 2/1989 | Beretta | |
| 5,053,264 | A | 10/1991 | Beretta | |
| 5,419,659 | A | 5/1995 | Mercer | |
| 7,001,112 | B2 | 2/2006 | Walsh | |
| 9,315,953 | B2 | 4/2016 | White | |
| 9,556,580 | B2 | 1/2017 | Walsh | |
| 10,024,002 | B2 | 7/2018 | Walsh | |
| 10,501,896 | B2 | 12/2019 | Walsh | |
| 11,519,150 | B2 * | 12/2022 | Curson | E02D 17/202 |
| 2003/0012608 | A1 * | 1/2003 | Race | E02D 29/0241 405/284 |
| 2004/0062615 | A1 | 4/2004 | Walsh | |
| 2009/0129862 | A1 * | 5/2009 | Thiel | E01C 3/003 404/75 |
| 2009/0214821 | A1 | 8/2009 | Walsh | |
| 2012/0123963 | A1 | 5/2012 | Messmer | |
| 2018/0298582 | A1 | 10/2018 | Shelton | |
| 2019/0383015 | A1 | 12/2019 | Wendeler-Goeggelmann | |
| 2020/0173118 | A1 | 6/2020 | Walsh | |

FOREIGN PATENT DOCUMENTS

| | | | |
|---|---|---|---|
| CN | 102615817 | | 8/2012 |
| CN | 102615818 | * | 8/2012 |
| CN | 203855867 | | 10/2014 |
| CN | 205171489 | | 4/2016 |
| CN | 205421227 | | 8/2016 |
| CN | 205990615 | | 3/2017 |
| CN | 208039219 | | 11/2018 |
| WO | 2019058113 A1 | | 3/2019 |
| WO | 2020068496 A1 | | 4/2020 |

OTHER PUBLICATIONS

Webster, S.L., Geogrid reinforced based courses for flexible pavements for light aircraft: Test section construction, behavior under traffic, laboratory tests, and design criteria. Report DOT/FAA/RD-92, Dec. 1992.

Ghafoori, Nader, Ph.D. et al. Use of geogrid for strengthening and reducing the roadway structural sections. NDOT Research Report No. 327-12-803, Jan. 2016.

"Geosynthetic Design & Construction Guidelines—Reference Manual—NHI Course No. 132013," U.S. Department of Transportation Federal Highway Administration Publication No. FHWA NHI-07-092, Aug. 28, 2008.

* cited by examiner

| | 500 | 501 | | |
|---|---|---|---|---|
| | PATTERNED DISC. | MONOLAYER | | |
| | | 4.45mm | 5.45mm | 6.45mm |
| A | 2.86 | 1.47 | 1.62 | 1.85 |
| B | 2.12 (LOWEST) | - | - | - |
| C | 2.90 (HIGHEST) | - | - | - |
| D | 2.53 | - | - | - |
| E | 2.40 | - | - | - |
| AVERAGE RIB ASPECT RATIO | 2.66 | 1.47 | 1.62 | 1.85 |

604

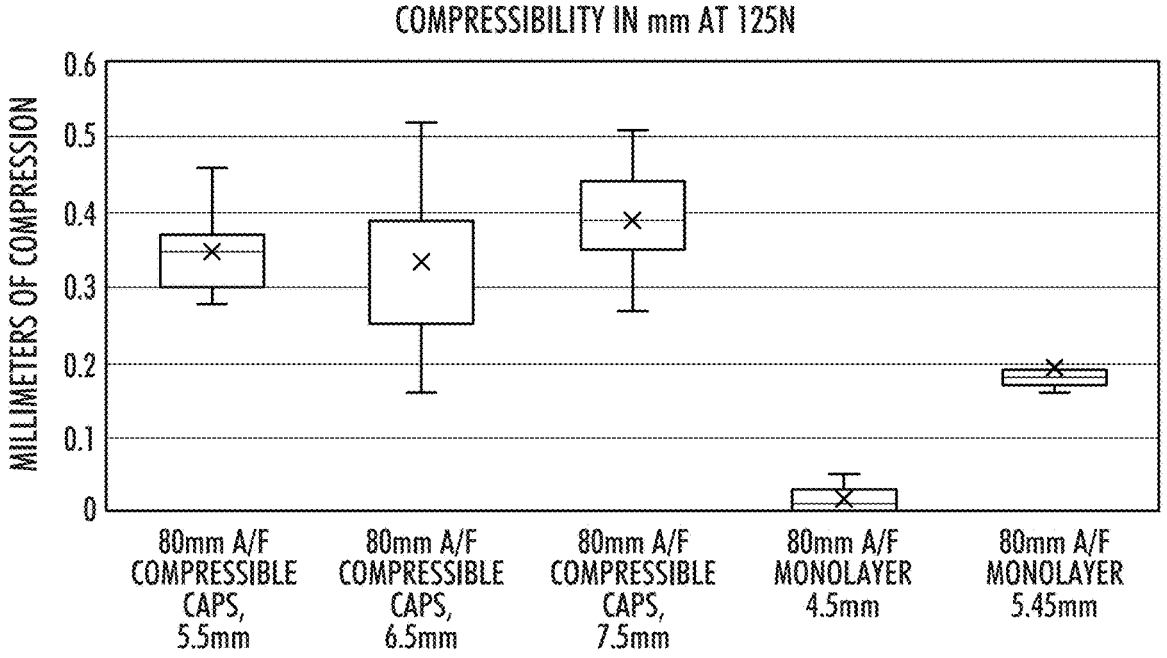
FIG.14B
FIG.14C
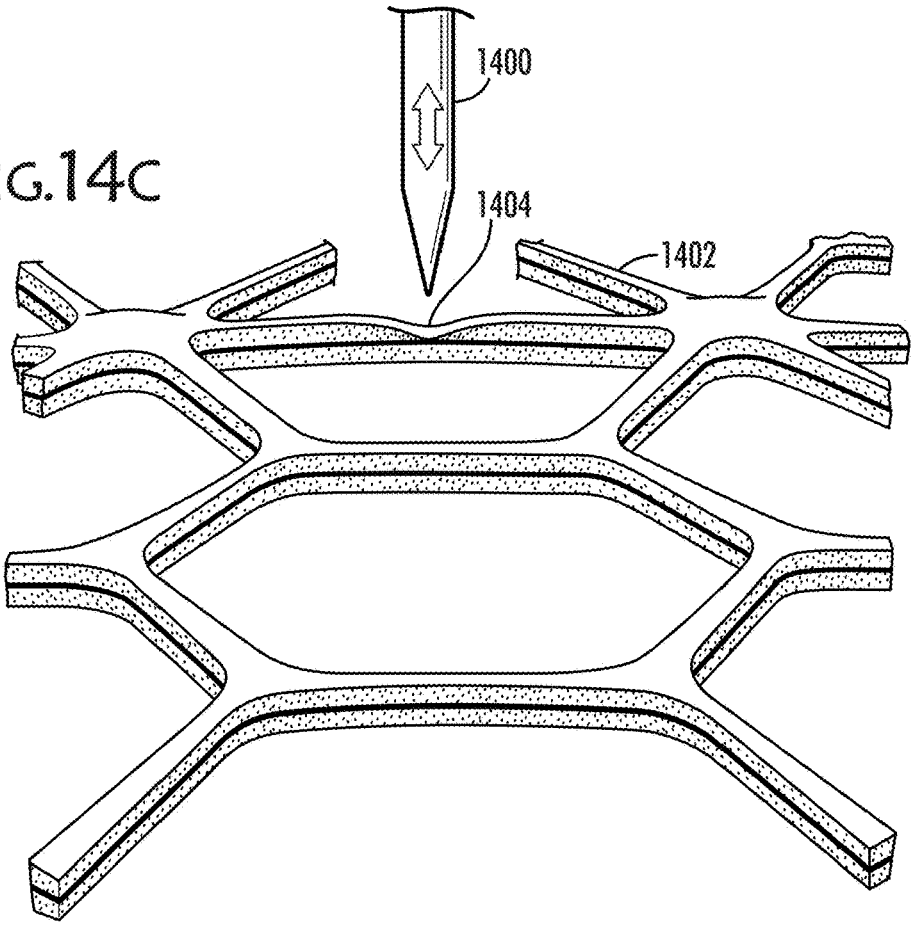

| | AVERAGE VALUES | |
|---|---|---|
| | PEAK STRESS (psi) | STRAIN AT PEAK STRESS (%) |
| CONTROL | 55.9 | 1.81 |
| PATTERN Grid A | 70.2 | 2.17 |
| PATTERN Grid B | 71.1 | 2.08 |
| PATTERN Grid C | 71.6 | 2.27 |
| PATTERN Grid D | 71.0 | 1.92 |
| PATTERN Grid E | 70.1 | 1.82 |
| PATTERN Grid F | 72.0 | 2.07 |

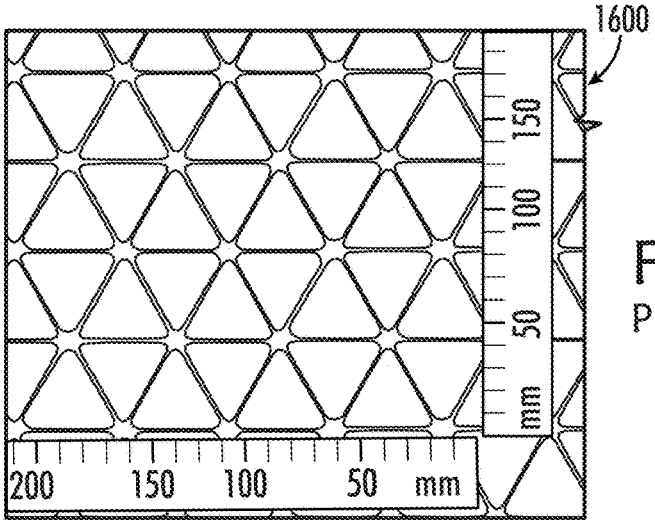
FIG.16A
PRIOR ART
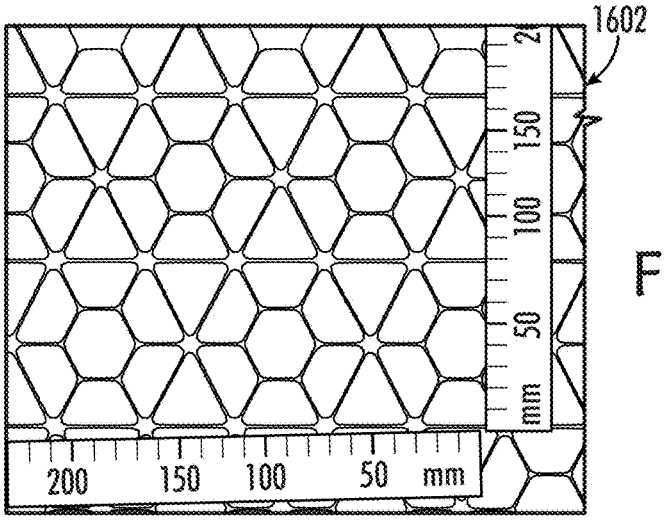
FIG.16B
| | FIG.16B | FIG.16A |
|---|---|---|
| Unoriented Nodes Per m2 (Measured and Extrapolated) | 384 | 480 |
| Oriented Tensile Elements Per m2 | 2224 | 1424 |
| Open Area | 85% | 85% |
| Average Aperture Open Area, mm ^ 2 | 588 (see breakdown) | 794 |
FIG.16C

HORIZONTAL MECHANICALLY STABILIZING GEOGRID WITH IMPROVED GEOTECHNICAL INTERACTION

CROSS-REFERENCE TO RELATED APPLICATIONS

This application is continuation application of U.S. patent application Ser. No. 17/557,474 filed Dec. 21, 2021, which is a continuation-in-part application of both U.S. patent application Ser. No. 17/355,843 entitled "Multi-Axial Integral Geogrid and Methods of Making and Using Same" filed Jun. 23, 2021, now U.S. Pat. No. 11,390,015, and International Patent Application No. PCT/US2021/038863 entitled "Multi-Axial Integral Geogrid and Methods of Making and Using Same" filed Jun. 24, 2021; both applications which further are related and claim priority to U.S. Provisional Patent Application No. 63/043,627 entitled "Multi-Axial Integral Geogrid and Methods of Making and Using Same" filed Jun. 24, 2020, U.S. Provisional Patent Application No. 63/154,209 entitled "Multilayer Integral Geogrids Having a Cellular Layer Structure, and Methods of Making and Using Same" filed Feb. 26, 2021, and U.S. Provisional Patent Application No. 63/154,588 entitled "Horizontal Mechanically Stabilizing Geogrid with Improved Geotechnical Interaction" filed Feb. 26, 2021. The entire disclosures of said applications are incorporated herein by reference in their entireties.

FIELD

The present disclosure relates generally to horizontal mechanically stabilizing geogrid used for structural reinforcement of soils, aggregates and related materials, including stabilization, and other geotechnical purposes. More particularly, the present disclosure relates to, among other things, geogrid having a pattern of strong axis ribs interspersed with a pattern of engineered discontinuities, and improving performance within geotechnical interactions through a compressible cellular layer, as well as other desirable characteristics as disclosed herein.

BACKGROUND

Roadway and earthwork construction, an aspect of geotechnical engineering, is an engineering practice that is generally facilitated by cutting or filling the ground to sub-grade and backfilling or adding compacted natural materials such as stone or aggregate base course. The importance of pavement lifecycle increases as material costs increase and material selection decreases. Further, with increasing traffic, and the sophistication of the traffic (weights, force angles, materials, and more), the lifetime of pavement is further diminished. The combination of environmental impacts, costs of materials, and geotechnical engineering development led to designs and construction processes including bound materials, such as asphalt and Portland cement concrete.

Pavement lifetime depends on the quality (strength and stiffness) as well as the thickness of the subgrade and pavement materials, as well as environmental conditions, the magnitude of traffic loading, and the repetition of traffic loading. Traffic loading is often represented as an equivalent single axle load (ESAL). This standardized metric allows loads with magnitudes higher or lower than a standard ESAL to be converted to standard ESAL through the number of load repetitions.

Pavement lifetime is impacted by environmental conditions in different ways. For example, areas with problematic soil, such as soil with expansive residuum, pose significant issues for geotechnical engineering. Other environmental conditions, such as the freeze-thaw cycle in northern latitudes further impact the pavement lifecycle. Even further, the weak and compressible soils encountered along coastlines or near waterways also pose additional challenges. One method that addresses these various environmental impacts is additional excavation, or over-excavation, wherein the base materials are re-compacted or removed and replaced with more suitable materials. This method has the disadvantage of requiring expensive materials and heavy equipment costs. Another method of improvement is to blend the soil with Portland cement and/or other admixtures. This method is carbon intensive and costly, and further requires additional equipment and resources that are typically found outside of the geotechnical environment.

The manufacture and use of integral geogrids and other integral grid structures can be accomplished by well-known techniques. As described in detail in U.S. Pat. No. 4,374,798 to Mercer, U.S. Pat. No. 4,590,029 to Mercer, U.S. Pat. No. 4,743,486 to Mercer and Martin, U.S. Pat. No. 4,756,946 to Mercer, and U.S. Pat. No. 5,419,659 to Mercer. A starting polymeric sheet material is first extruded and then punched to form the requisite defined pattern of holes or depressions. The integral geogrid is then formed by the requisite stretching and orienting of the punched sheet material. Such integral geogrids, both uniaxial integral geogrids and biaxial integral geogrids (collectively "integral geogrids," or separately "uniaxial integral geogrid(s)" or "biaxial integral geogrid(s)") were invented by the aforementioned Mercer in the late 1970s and have been a tremendous commercial success over the past 35 years, completely revolutionizing the technology of reinforcing soils, roadway under pavements, and other geotechnical or civil engineering structures made from granular or particulate materials. Mercer discovered that by starting with a relatively thick, substantially uniplanar polymer starting sheet, preferably on the order of 1.5 mm (0.059055 inch) to 4.0 mm (0.15748 inch) thick, having a pattern of holes or depressions whose centers lie on a notional substantially square or rectangular grid of rows and columns, and stretching the starting sheet either unilaterally or bi-axially so that the orientation of the strands extends into the junctions, a totally new substantially uniplanar integral geogrid could be formed. As described by Mercer, "uniplanar" means that all zones of the sheet-like material are symmetrical about the median plane of the sheet-like material.

The Mercer disclosures taught the merits of polymeric uniaxial and biaxial integral geogrids. The mesh like geometries having strands or ribs in one or two directions provided a solution to soil and geotechnical stabilization. The Mercer disclosures further addressed the manufacture of and the need for rapid large-scale development of polymeric integral geogrids. The improvements replaced traditional metallic materials used in geotechnical stabilization, and, unlike metallic materials, the polymeric integral geogrids did not suffer from rapid corrosion and degradation, further increasing the usable lifetime of the geotechnical installation. The Mercer disclosures have seen tremendous commercial success and have become ubiquitous in earthwork projects. However, there are certain limitations to the Mercer disclosure, namely, the ribs or stands travel in one or two directions, and that limits the surface contact with the environment.

In U.S. Pat. No. 3,252,181 to Hureau, U.S. Pat. No. 3,317,951 to Hureau, U.S. Pat. No. 3,496,965 to Hureau, U.S. Pat. No. 4,470,942 to Beretta, U.S. Pat. No. 4,808,358 to Beretta, and U.S. Pat. No. 5,053,264 to Beretta, the starting material with the requisite pattern of holes or depressions is formed in conjunction with a cylindrical polymer extrusion and substantial uniplanarity is achieved by passing the extrusion over an expanding mandrel. The expanded cylinder is then slit longitudinally to produce a flat substantially uniplanar starting sheet. Another integral geogrid is described in U.S. Pat. No. 7,001,112 to Walsh (hereinafter the "Walsh '112 patent"), assigned to Tensar International Limited, an associated company of the assignee of the instant application for patent, Tensar International Corporation (hereinafter "Tensar") of Alpharetta, Georgia. The Walsh '112 patent discloses oriented polymer integral geogrids including a bi-axially stretched integral geogrid in which oriented strands form triangular mesh openings with a partially oriented junction at each corner, and with six highly oriented strands meeting at each junction (hereinafter sometimes referred to herein as "triaxial integral geogrid"). The triaxial integral geogrids of the Walsh '112 patent have been commercialized by Tensar to substantial success.

Continued improvements to integral geogrids are disclosed in U.S. Pat. No. 9,556,580 to Walsh, U.S. Pat. No. 10,024,002 to Walsh, and U.S. Pat. No. 10,501,896 to Walsh, all of which are assigned to Tensar Technologies Limited, another associated company of the assignee of the instant application for patent. The aforementioned Walsh U.S. Pat. Nos. 9,556,580, 10,024,002, and 10,501,896 disclose an integral geogrid having what is known to one skilled in the art as a high aspect ratio, i.e., a ratio of the thickness or height of the strand cross section (also referred to as a rib or rib height) to the width of the strand cross section, that is greater than 1.0. While it has been shown that the performance of multiaxial integral geogrids can be improved by using a geogrid structure that has ribs with an aspect ratio greater than 1.0, the increase in aspect ratio comes with increases in the overall amount of polymer required, thus increasing the weight and cost of the geogrid.

Traditionally, the polymeric materials used in the production of integral geogrids have been high molecular weight homopolymer or copolymer polypropylene, and high density, high molecular weight polyethylene. Various additives, such as ultraviolet light inhibitors, carbon black, processing aids, etc., are added to these polymers to achieve desired effects in the finished product and/or manufacturing efficiency. And, also traditionally, the starting material for production of such integral geogrids has typically been a substantially uniplanar sheet that has a monolayer construction, i.e., a homogeneous single layer of a polymeric material. While an integral geogrid produced from the above-described conventional starting materials exhibits generally satisfactory properties, it has been structurally and economically advantageous to produce integral geogrids having a relatively higher degree of stiffness suitable for the demands of certain applications such as geosynthetic reinforcement or having other properties desirable for a particular geosynthetic application.

Most recently, manufacturing techniques have improved in the punched-and-drawn geogrids. For example, improvements disclosed in U.S. patent application Ser. No. 15/766,960 to Tyagi, published as U.S. Patent Application Publication No. 2018/0298582 and assigned to Tensar Corporation, LLC. Wherein the Tyagi application discloses manufacturing geogrids using a multiple-extrusion (co-extrusion) process to form a unitary grid comprised of integral planar sub-layers, Tyagi further discloses the formation of a multilayer material comprised of both virgin materials to the exterior of the layer and recycled polymeric material interior or as the core of the layer. Therefore, advancing integral geogrids with renewable and reusable material, the concept effectively reduced the environmental impact of integral geogrids. However, Tyagi fails to disclose inclusion and incorporation of compressive materials to improve the performance of the geogrid as it relates to the lifecycle of pavement, and to improve results with the increased variety of pavement trafficking.

Therefore, a commercial and environmental need exists for a material and system that is not only suitable for the efficient processes associated with the production of integral geogrids, but also provides a higher degree of performance over geogrids associated with conventional means and provides additional properties and advantages not available with current monolayer integral geogrids. In particular, a need exists to reduce the overall environmental impact and production costs by substituting new materials disclosed herein, and in doing so increase the overall performance and lifecycle of integral geogrids. Furthermore, while an integral geogrid produced by conventional starting materials and geometries may exhibit generally satisfactory properties, it is structurally and economically advantageous to produce an integral geogrid having a structure, geometry, and materials that allow for the ability to engage with and stabilize a greater variety and range of quality of aggregates and soils at a lower cost and in an environmentally friendly manner. Of great importance, it is economically and environmentally advantageous to produce a system that lengthens the design life of pavement systems without adding commensurate economic and environmental costs.

Therefore, this disclosure enables a broader set of geotechnical applications, and can make use of lower grade aggregate, further improving geotechnical engineering efficiencies and lowering the cost of earthwork and geotechnical projects.

SUMMARY

Aspects of a geogrid system for improving substrate interactions within a geotechnical environment are disclosed. In one aspect, a geogrid system is disclosed for improving substrate interactions within a geotechnical environment. The system comprising a geotechnical environment. Further, the system comprising a substantially planar geogrid. The geogrid comprising a plurality of strong axis ribs and nodes. Along with a patterned structure of engineered discontinuities to enhance substrate compaction and increase out-of-planar stiffness. Lastly, the geogrid comprises a compressible cellular layer that increases geogrid aspect ratio.

In another aspect, a geogrid system for improving substrate interactions within a geotechnical environment is disclosed. The geogrid system comprising a geotechnical environment. The geogrid system further comprising a horizontal multilayer mechanically stabilizing geogrid. The horizontal multilayer mechanically stabilizing geogrid comprises a geogrid with nodes and ribs, the geogrid comprising patterned discontinuities and a plurality of strong axis ribs. Further the horizontal multilayer mechanically stabilizing geogrid comprises a core comprising a polymeric material, along with the top and/or a bottom surface of the core, having a compressible cellular layer, forming a compressible cap.

In another aspect, a geogrid system for improving substrate interactions within a geotechnical environment is disclosed. The geogrid system comprising a geotechnical environment. The geogrid system further comprising a horizontal multilayer mechanically stabilizing geogrid. The horizontal multilayer mechanically stabilizing geogrid comprising a core, wherein the core is comprised of a compressible cellular layer that increases aspect ratio of the horizontal multilayer mechanically stabilizing geogrid. The horizontal multilayer mechanically stabilizing geogrid further comprising a top and bottom surface of the core having a layer of polymeric material, forming a compressible core.

In another aspect, a method for improving geotechnical environments with a horizontal multilayer mechanically stabilizing geogrid is disclosed. The method comprises applying a geogrid with a plurality of strong axes, patterned discontinuities, and a compressible cellular layer with heightened aspect ratio to a geotechnical environment. Wherein applying the horizontal multilayer mechanically stabilizing geogrid, places the geogrid into aggregate and soil. Next, the horizontal multilayer mechanically stabilized geogrid reduces lateral movement of the aggregate and soil within the geotechnical environment. Lastly, increasing, by the horizontal multilayer mechanically stabilized geogrid, lifetime cycles of trafficking over the geotechnical environment.

The aforementioned embodiments are but a few examples of configurations of the systems, apparatuses, and methods disclosed herein. Further understanding and a detailed coverage of the embodiments follows herein.

BRIEF DESCRIPTION OF DRAWINGS

Many aspects of the present disclosure will be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views. It should be recognized that these implementations and embodiments are merely illustrative of the principles of the present disclosure. Therefore, in the drawings:

FIG. 14B is a chart illustrating an example of compressibility in mm at 125 N force, utilizing the test in FIG. 14, with an example of triangle or triaxial geometry with a plurality of strong axes and patterned discontinuities, along with examples of prior art geogrids;

FIG. 14C is an illustration of an example test for determining compressibility in FIGS. 14A-B;

FIG. 16A is an illustration of an example polymeric triangle or triaxial geogrid without patterned discontinuities or a plurality of strong axes (Prior Art);

FIG. 16B-C illustrates an example of a triangle or triaxial geogrid with a plurality of strong axes and engineered pattern discontinuities, in this example the polymeric material is on the top and the bottom of a compressible cellular layer, referred to herein as a compressible cellular core or compressible core, and illustrates within the chart of C the geometry differences;

DETAILED DESCRIPTION

Figure 1A:
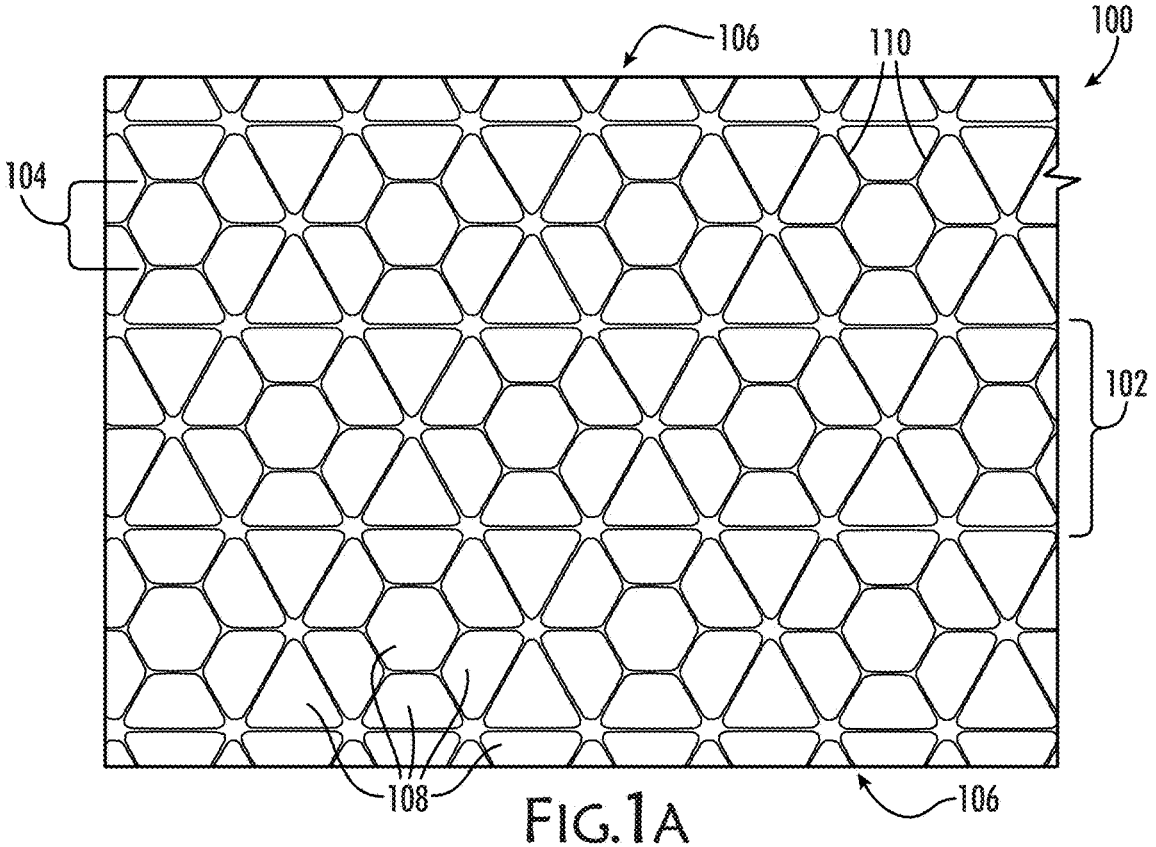
FIG. 1A illustrates an example of a horizontal mechanically stabilized geogrid with patterned discontinuity and a plurality of strong axes.

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

Throughout this specification and the claims, the terms "comprise," "comprises," and "comprising" are used in a non-exclusive sense, except where the context requires otherwise. Likewise, the term "includes" and its grammatical variants are intended to be non-limiting, such that recitation of items in a list is not to the exclusion of other like items that can be substituted or added to the listed items.

Geogrids confine aggregate based on the interactions of aggregate with grid apertures, grid nodes, grid ribs, grid angles, grid chemical properties, grid surface area, and rib to flat-plane distance. These elements interact with soil and aggregate to form a geotechnical environment. Within the geotechnical environment, the geogrid apertures form void regions or open regions between the geogrid nodes and geogrid ribs. Different node and rib heights, aspect ratio, and lengths create a variety of contact surface as well as confinement angularity. Precise geometries rely on extensive testing to develop geogrid geometries and other embodiments as disclosed herein. For example, the presentation of multiple contact surfaces and angles, as depicted in the brush off test (FIGS. 2A-B) and the compressibility data (FIGS. 14A-B), illustrates that, in some examples, the increased confinement of aggregate is possible through minor changes. Testing also indicates that the inclusion of engineered pattern discontinuities (e.g. geometry of FIG. 1A) in a framework of strong axis ribs (e.g. a plurality of strong axes), reduces the resistance to aggregate compaction, increasing aggregate density, as well as stiffness under vertical load. Additional testing further indicates the positive effect on lateral and vertical constraint on aggregate accentuated by the multilayer design (FIGS. 17B-C), wherein in one embodiment the polymeric material forms a rigid backbone, on the top and bottom, the compressible cellular layer is formed in between, this example is also known as a compressible cellular core, wherein the compressible cellular layer (compressible core) further locks in aggregate and improves results within a geotechnical environment.

In one aspect, the compressible cellular layer is on the outside of polymeric material, this example is referred to herein as a compressible cap or compressible cellular cap, and forms a compressible cellular layer. The polymeric material may be virgin material or a mix of recycled polymeric material, such as a thermoplastic polymer of polypropylene, polyethylene, or polyester, to name a few. Any thermoplastic that meets the necessary physical and mechanical properties may be imparted to the geogrid. Compressibility in the outer layers of a multilayer geogrid creates microscopic fissures around materials engineered for particle size, particle size distribution, and surface energy dispersed in a polymeric matrix of an extruded sheet. In one example, the compressible cellular layer, either a compressible cap or compressible core, on the thermoplastic polymeric sheet ranges from 3 mm to 10 mm in aspect ratio, and is comprised of $CaCO_3$. In other aspects, a foam additive or other particulate filler may comprise the compressible core or compressible cap. The fissures form, from the example of the $CaCO_3$, within the compressible cellular layer which may extend from a range of 1% to 500% in aspect ratio during multiaxial orientation of an attenuated polymeric matrix. These fissures trap soil and aggregate and further serve as an increase in surface area and surface roughness. Thus during the manufacturing process, the coextruded polymeric sheet with particulate filler may undergo thinning and elongation, creating fissuring.

In one aspect, when the compressible cellular layer undergoes load, the fissures undergo deformation, allowing the compressible cellular layer to increase the inter-particle interaction with the compacted aggregate, similar to crush fitting. Another aspect of the compressible cellular layer is the ability of the fissures within to elongate during orientation, thereby further increasing surface roughness that have been recorded between 2 times and 10 times greater than average surface variability or roughness. Traditional polymeric geogrids lack the surface roughness, and further lack the crush fitting capability, and thus are less capable of confining aggregates placed in the apertures. The compressible cellular layer further increases surface energy by changing the standard polymeric from a hydrophobic response to a hydrophilic response wherein in some embodiments the hydrophilic nature of the compressible cellular layer allows for further inter-particle interaction as the cohesive forces from the water molecule interaction with the substrate, soil, and compressible layer further bind the backfilled material to the compressible cellular layer.

Discussing now the compressible cellular layer, wherein on aspect is to accommodate a full range of aggregate types and sizes. Aggregate types vary from process to crushed stone, gravel, sand, and fill. The increase in surface roughness from fissuring under compression aids in compacting and further "locking-in" of aggregate in the geotechnical environment by allowing the smaller particles found in all types of aggregate to interact with the surface of the compressible cellular layer and further embed into the structure. A geotechnical environment, as is known and understood herein is an environment in which a geogrid is in use with aggregate to improve soil conditions. Geotechnical environments are often used to support pavement, or areas of high traffic or heavy loads. Additional uses may be to support infrastructure, including buildings, bridges, roads, rail, and other infrastructure as will be known by a geotechnical engineer.

In one aspect, the object of the instant disclosure is to deliver improved functional performance from horizontal multilayer mechanically stabilizing geogrids, which in one example are triangle or triaxial geogrids with engineered pattern discontinuities, a plurality of strong axes, and a compressible cellular layer, such as a core or a cap. Horizontal or substantially planar geogrids are placed, or introduced within the geotechnical environment and their orientation relative to the direction of gravity may deviate based upon slope, gradient, and location within the soil and aggregate. Geogrid improvements within the soil are achieved by enhancing certain physical, mechanical, and geometrical properties of the geogrid structure that improves functional performance within a geotechnical environment. Examples of improvements, in certain aspects, include modifying and/or incorporating other new physical, mechanical, chemical, and geometrical properties with a multilayer system, whether that be with two polymeric sheets and a compressible cellular core, or a compressible cellular cap on a backbone of a polymeric sheet. In these examples, and provided in the illustrations, the results occurred due to precise physical geometrical positioning, utilizing force vectors and other physical properties (e.g. geometry, aspect ratio, surface area), and by adjusting the amount of different polymeric materials, particulate fillers, material fillers, and engineered foaming agents, to have the desired mechanical and physical properties in specific locations of the horizontal mechanically stabilized geogrid.

Another aspect of the disclosure is to provide a horizontal multilayer mechanically stabilizing geogrid in which layers thereof are modified to reduce the amount of polymer required by converting the polymer in those layers from a solid, i.e., continuous, structure to a cellular structure, i.e., a structure having dispersed therein a plurality of voids, cavities, pores, bubbles, holes, or other types of openings produced according to the methods described herein. More specifically, it has been discovered that improved geotechnical aspects may be achieved by the disclosure herein while utilizing less polymeric material. In one aspect, a compressible cellular layer, containing voids, cavities, pores, bubbles, holes, or other void containing structure creates a higher aspect ratio, which improves aggregate interaction at a lower cost. The heightened aspect ratio through the compressible cellular layer increase aggregate compaction and crush-fit while reducing the amount of polymeric material needed to manufacture. Further, the compressible cellular layer, with surface voids, allows for trapping of micro particles, thereby stabilizing smaller soil particulate sizes. In one aspect, the stabilization of micro particles further enhances macro soil particle stabilization. In this regard, the micro particles accumulate and form a stronger reinforcement and stabilization structure. In additional aspects, the polymeric material provides the axial rigidity, while the compressible cellular layer increases the overall stabilization through various micro and macro interactions with the soil.

In one aspect, the minimum thickness or height of the horizontal multilayer mechanically stabilizing geogrid having one or more void-containing compressible cellular layers is at least 3 mm and preferably greater than 4 mm. In another aspect, the minimum thickness or height of the multilayer geogrid is 7 mm. In even further aspects, the minimum thickness may be a variable range due to the compressible cellular layer having voids that may vary the thickness, including a range from 1 mm to 3 mm, and another range from 3 mm to 5 mm, and yet even further ranges from 5 mm to 7 mm and 5 mm to 10 mm. These ranges are given for understanding, it will be known by those of skill in the art the range may vary throughout the manufacture horizontal multilayer mechanically stabilizing geogrid, and that depending upon the compressible cellular layer, the chemical makeup and the manufacture, such ranges will likely vary.

In another aspect, the aspect ratio of the ribs of the horizontal multilayer mechanically stabilizing geogrid that comprises one or more void-containing cellular layers is between at least 1:1 and 3.5:1. In another aspect, the initial height or thickness of the one or more void-containing compressible cellular layers at their thinnest height (likely the midpoint of the strands or ribs) is at least 3 mm, and preferably at least 5 mm. In another aspect, the voids or cellular openings of the one or more void-containing compressible cellular layers comprise at least twenty-five percent (25%) by volume of the one or more void-containing cellular layers, and preferably at least fifty percent (50%). In other embodiments, the compressible cellular layers the one or more void-containing cellular layers have a minimum "compression" or height reduction under load of at least twenty-five percent (25%) after compaction is complete under load, and preferably at least fifty percent (50%). In another exemplary embodiment, the one or more void-containing cellular layers have an aspect ratio such that their height or thickness is at least 2:1 to the height or thickness of the thinnest inner layer, and preferably at least 3:1; and the one or more void-containing cellular layers have a height or thickness that is at least forty percent (40%) of the overall height of the final integral geogrid, and preferably at least seventy percent (70%).

In one aspect, the compressible cellular layer provides increased surface roughness, whereas by increasing the surface area due to the void-containing regions of the compressible cellular layer, the backfilled soil and aggregate particles adhere to the surface creating greater overall soil retention and stabilization. Surface roughness, or texture, is the measure of the surface irregularities in the surface texture, and is typically composed of three elements: 1) roughness, 2) waviness, and 3) form. Wherein calculating surface roughness average (Ra), also known as the arithmetic average, is the average deviation of the peaks and valleys expressed in mm, ISO standards use the term center line average, wherein Ra=CLA=M1+M2+M3+M4/4. Advantages of compressible cellular layers on the surface of polymeric material increases surface area and thereby provides increased friction and trapping of soil particles (See FIG. 24A). In one aspect, the compressible cellular layer with the increased particle interaction area due to the voids and roughness allow for trapping of particles and reduced horizontal movement (See FIGS. 23A-B). In other aspects, soil stabilization through the compressible cellular layer allows for use of lower grade materials, increasing the environmental savings and providing increased stabilization and longer infrastructure lifecycle.

In one aspect, multilayer geogrids are disclosed wherein the multilayer geogrid has varying aspect height ratio at the primary nodes and the dependent nodes. In this aspect, the primary nodes are the nodes that form the outer boundary, having an isotropic geometry with 2 or 3 continuous ribs that are balanced. This balanced geometry, comprised of continuous ribs extending in 2, 3, or more planar directions is interspersed with engineered discontinuities comprised of non-continuous ribs and non-functional nodes.

I. SYSTEMS AND METHODS OF A HORIZONTAL MECHANICALLY STABILIZED GEOGRID

Figure 1B:
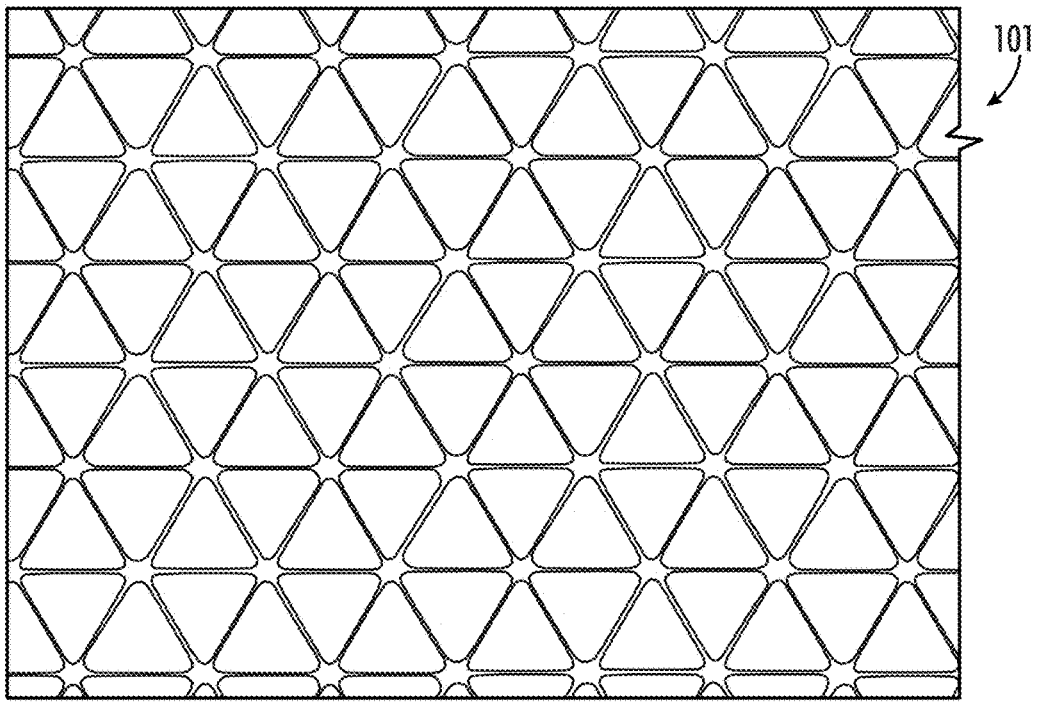
FIG.1B PRIOR ART
FIG. 1B illustrates an example of a triaxial geogrid without patterned discontinuities or a plurality of strong axes (Prior Art)

In this respect, referring now to FIGS. 1A-B, which shows both a triaxial rib arrangement 101 in FIG. 1B (Prior Art), and in FIG. 1A, a horizontal mechanically stabilized geogrid 100, having an arrangement of patterned engineered discontinuities, and a plurality of strong axes are exemplified as hexagons or hexagonal geometry. In one embodiment, the height at the primary nodes or non-functional nodes 102 (outer hexagon) may be 7 mm, whereas the height of the secondary nodes or functional nodes 104 (inner hexagon) may be 5 mm, thereby creating limited movement in the Z-direction that allows for limited differential settlement and nesting of aggregate and soils. In one embodiment, the concave and geometrically pliable nature of the interior discontinuity, shown in FIG. 1A as a suspended hexagon, forms a carrier area of the planar geogrid that allows aggregate to settle into and compress within the layer, allowing for lateral aggregate movement during compaction, further trapping particles and stabilizing the geotechnical environment. In an additional aspect, a compressible cellular layer, such as a compressible cap or compressible core, may have additives such that act as an isotropic stiffening agent that stabilize and provide additional axial rigidity to the ribs, thereby allowing for reduced polymeric use in manufacture.

Continuing with FIG. 1A, a horizontal multilayer mechanically stabilizing geogrid 100 has primary 102 and secondary nodes 104, wherein the secondary nodes 104 provide greater nesting of the aggregate and the primary nodes 102 provide planar rigidity and stiffness. In one aspect, the primary nodes 102 form an outer hexagon comprised of continuous ribs (strong axis) 106 and the secondary nodes 104 form an inner hexagon that form a planar discontinuity with non-continuous ribs 110, referred to as patterned discontinuity or engineered discontinuity, wherein the primary nodes 102 provide stability and stiffness to the geogrid, and the secondary nodes 104 aid in trapping of aggregate and micro particles during placement and compaction (See also FIG. 5). Therefore, the patterned structure of engineered discontinuities enhances substrate compaction and increase out-of-planar system stiffness. In-plane loading is loading along the axis of the surface, in some regard this may be demonstrated as x axis loading. Out of plane loading or out-of-plane loading is loading perpendicular to the surface, such as z axis loading. Thus, the patterned discontinuities increase performance by increasing system stiffness in loading perpendicular to the surface, the pattern along with a plurality of strong axes provide lateral restraint perpendicular to the placement of the geogrid.

Further, the primary 102 and secondary nodes 104 may optionally be configured with multiple compressible cellular layers (1, 3, 5, etc.), wherein each layer may have voids or pores wherein additives (discussed later, such as particulate fillers or foam additives) may be used to increase or decrease rib axial rigidity or optionally increase of surface compressibility.

Figure 24A:
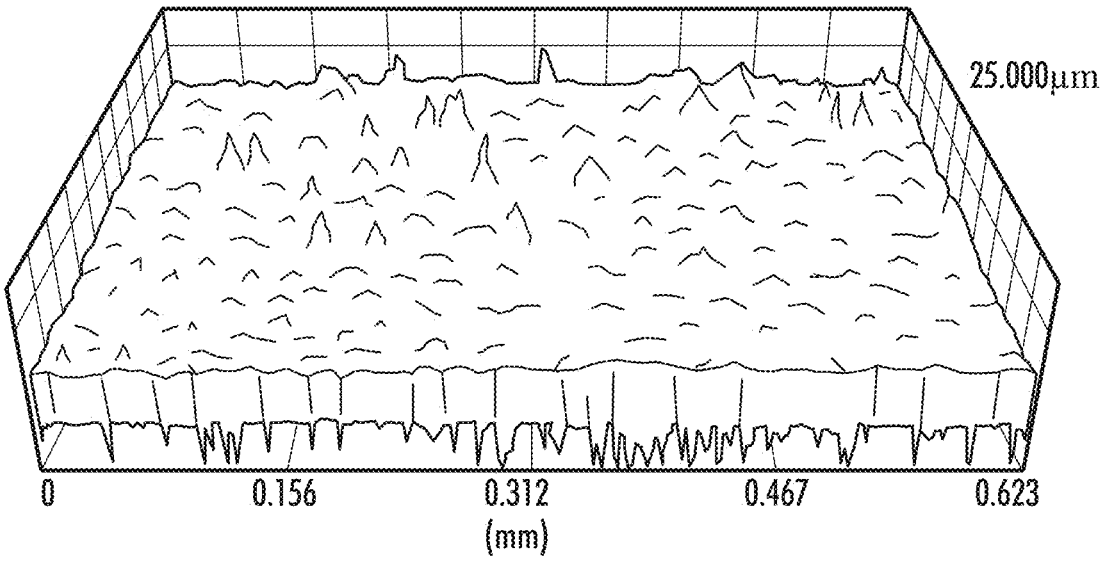
FIGS. 24A-B illustrates an example of a microscopic view of a comparison between a polymeric surface and a compressible cellular layer surface, such as a compressible cellular cap, illustrating the increased roughness from the compressible cellular layer.

In another aspect, a horizontal multilayer mechanically stabilizing geogrid 100 is disclosed, wherein the core of the geogrid is comprised of a cellular structure, referred to as a compressible cellular core layer. The cellular structure is supported on the exterior, for example, the top and bottom by polymeric material that defines the rigidity of the multilayer geogrid (See FIGS. 17B-C). The cellular layer may be compressible or have additives, such as a foaming agent, that increase axial rigidity depending upon the aggregate and soil within the geotechnical environment. Further, the polymeric top and bottom may be coated with an agent, such as a foaming agent disclosed herein, or other agent such as a particulate agent or filler, to increase surface roughness and increase surface energy, as illustrated in FIG. 24A, thereby providing increased soil adhesion and soil stabilization.

Figure 9:
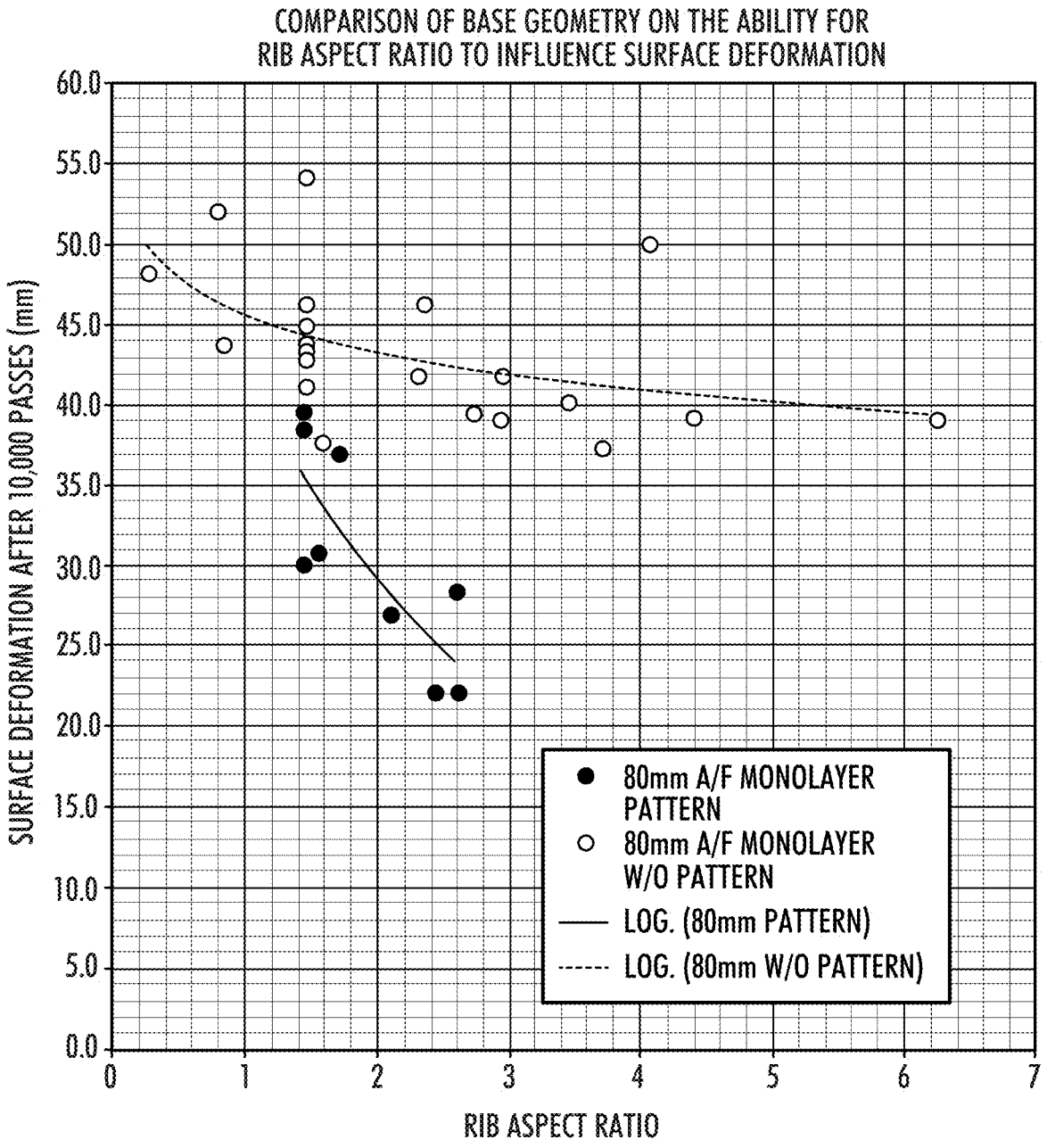
FIG. 9 illustrates an example comparison of rib aspect ratio depicting diminished returns for both geometries of triangle or triaxial geogrid with patterned discontinuities and a plurality of strong axes and a triaxial geogrid without discontinuities and without a plurality of strong axes as they undergo 10,000 trafficking passes.

Referring again to FIG. 1B illustrating an example of a patterned geogrid without discontinuity 101 (Prior Art), and FIG. 1A with patterned discontinuity and a plurality of strong axes (continuous ribs) 106. In the embodiment shown in FIG. 1A, the geometric pattern is triangle or triaxial, and the patterned discontinuity is represented as forming an inner hexagon 104. The discontinuity in some embodiments enable an aperture range to increase by 400%, thereby providing for both functional and non-functional nodes, and also whereby aggregate and substrate may become trapped for increased geotechnical stabilization, and lateral restraint. The benefit of increased aperture range provides for material savings, including cost and environmental benefits, while simultaneously increasing performance as demonstrated on testing of various geometries (FIG. 9).

As discussed previously, the apertures, or void regions 108 that fall between the ribs and nodes, each which may have heightened aspect ratio, are important features to interlocking aggregate, and thereby containing soil elements within a geotechnical environment. In contrasting prior art disclosures, the triangle or triaxial geogrid (FIG. 1B), with uniform aperture size and formation, lacks patterned discontinuity that allows for better trapping of varied aggregate, as aggregate is typically not uniform, and over time becomes even more varied. Further, the prior art geogrid in FIG. 1B lacks a plurality of strong axes that run continuously throughout the geogrid, and which provide for z axis or out of plane stiffening and rigidity. The patterned discontinuity in the horizontal stabilizing multilayer geogrid 100, in some aspects, forms a "basket" for holding substrate, as the inner and outer hexagon trap aggregate and soils. Further, when the hexagon geometry is optionally combined with the multilayer aspect, such as the co-extruded compressible cellular layer, the horizontal multilayer mechanically stabilizing geogrid 100 increases the stabilization and allows for use of lower grade substrate materials in even more challenging environments, such as those found in lowland environments with silt and clay materials.

The numerous advantages associated with the horizontal multilayer mechanically stabilizing geogrid 100, according to the present disclosure, are varied in nature and the materials selected differ per the environment in which the geogrid is installed. By virtue of the repeating discontinuities within a pattern of strong axes, oriented strands and openings, and heightened aspect ratio, the integral geogrid performs better at containing aggregate and soils over that lacking patterned discontinuities, and multi-layer features. The horizontal mechanically stabilized geogrid 100, with patterned discontinuities, a plurality of strong axes, and a compressible cellular layer can better accommodate varying aggregate sizes. While prior commercial geogrid structures typically have one basic shape and one limiting dimension, the exemplified horizontal mechanically stabilized geogrid, referred to throughout as the hexagonal geogrid geometry, or a triangle or triaxial geometry with patterned discontinuities leverages three different basic shapes—a hexagon, a trapezoid, and a triangle (See FIG. 4A). In turn, these shapes are defined and bound by oriented strands or ribs of varying shape and dimension. As such, the horizontal multilayer mechanically stabilizing geogrid 100 of the present disclosure can better accommodate the normally occurring varying angles, orientation, and sizes of aggregate as it is distributed across the geogrid. Further, the horizontal multilayer mechanically stabilizing geogrid 100 of the present disclosure provides an enhanced range of distribution of aperture size 108, resulting in the ability to engage with and stabilize a greater variety and range of quality of aggregates compared to that of triangles or rectangles of generally a single size as presented in prior multi-axial integral geogrids 101. The exemplified pattern of the horizontal multilayer mechanically stabilizing geogrid 100 shown in FIG. 1A has an unimpeded open inner hexagon, combined with the larger surrounding hexagon, thereby providing optimal aggregate confinement and lateral restraint. Further distribution of aperture size is achieved via repeating trapezoid and triangle shaped apertures.

By virtue of the repeating floating discontinuity within a strong axis pattern of the interconnected, continuous oriented strands and openings, the horizontal mechanically stabilizing geogrid of the present disclosure is also characterized by an increased number and type of strand elements relative to prior integral geogrids 101. Further, the geogrid of the present disclosure has an increased number of oriented tensile elements and a reduced number of partially oriented junctions. As such, the exemplified hexagonal geogrid of the present disclosure is characterized by a variety of degrees of out-of-plane and in-plane localized stiffness. While the hexagonal geometry of the present disclosure (exemplified in FIG. 1A) imparts overall greater in-plane rotational stiffness to the geogrid, the shorter length strands increase the rotational stiffness of the relative to that of prior geogrids (uniaxial, biaxial, triaxial) that do not contain a pattern of discontinuities. Thus, the exemplified hexagonal geogrid is characterized by a compliant, i.e., initial give or flexibility, that leads to better compaction and higher density, yet with a final horizontal aggregate geogrid composite stiffness that is greater as a result of the initial give. Further, as discussed previously, the hexagonal geogrid of the present disclosure has an increased number of confinement elements, i.e., strands, that provide concentric-like resistance to aggregate movement. In a like-for-like hexagon size, relative to a conventional triaxial integral geogrid, the multi-axial integral geogrid of this embodiment, of the present disclosure, provides nearly fifty percent more confinement elements to bear against radial loading motion during compaction and trafficking.

Figure 1C:
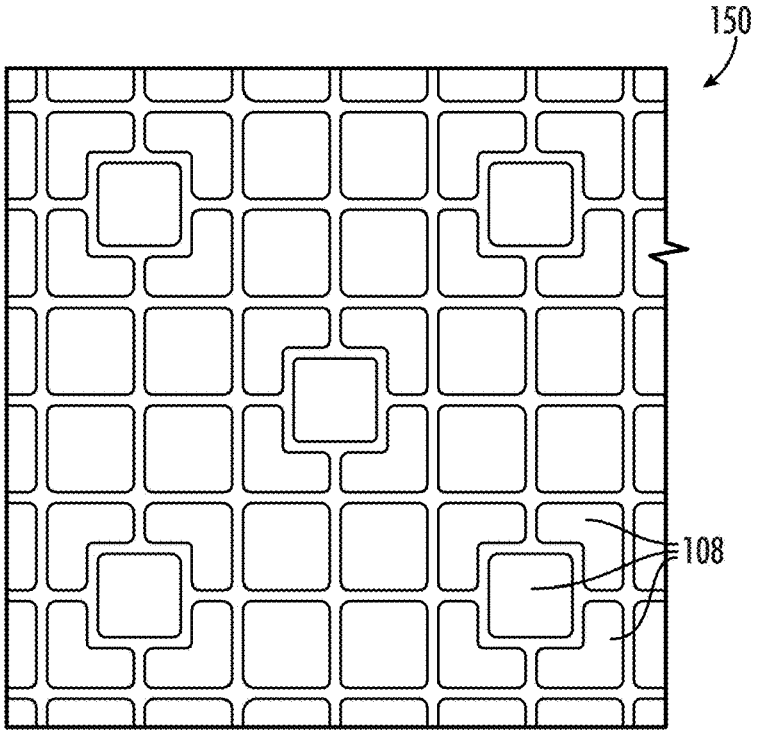
FIG. 1C illustrates an example of a rectangular geometry geogrid with patterned discontinuity.

FIG. 1C illustrates an example of a rectangular geometry, biaxial geogrid with patterned discontinuity 150. In the example a rectangle within a rectangle forms, similar to that of a hexagon, wherein the patterned discontinuity allows for micro and macro interactions, with lateral restraint of aggregate material, and a varying dimensionality of voids 108 that account for better trapping of aggregate. In one aspect, irregular aggregate interacts or has better compaction with a non-uniform geogrid, wherein the patterned discontinuity accepts a variety of shapes and sizes of aggregate.

Figure 1D:
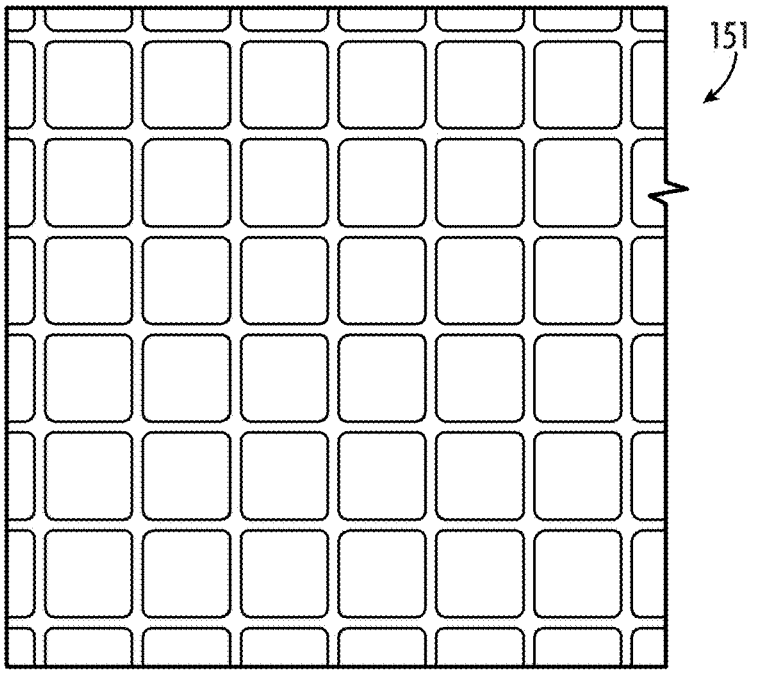
FIG.1D PRIOR ART
FIG. 1D illustrates an example of a rectangular geometry, biaxial geogrid without patterned discontinuity (Prior Art)

Referring to FIG. 1D, illustrating an example of a rectangular geometry, biaxial geogrid without patterned discontinuity 151 (Prior Art). In FIG. 1D, a traditional biaxial geogrid is disclosed, such geogrids are capable of improving compaction over a geotechnical environment lacking a geogrid. However, as mentioned above with regard to the patterned discontinuity, the uniform nature creates voids that do not allow for trapping or compaction of a wide variety of aggregate. Further, when placed in the environment, lateral forces are not dispersed as illustrated in the present disclosure.

Figure 2A:
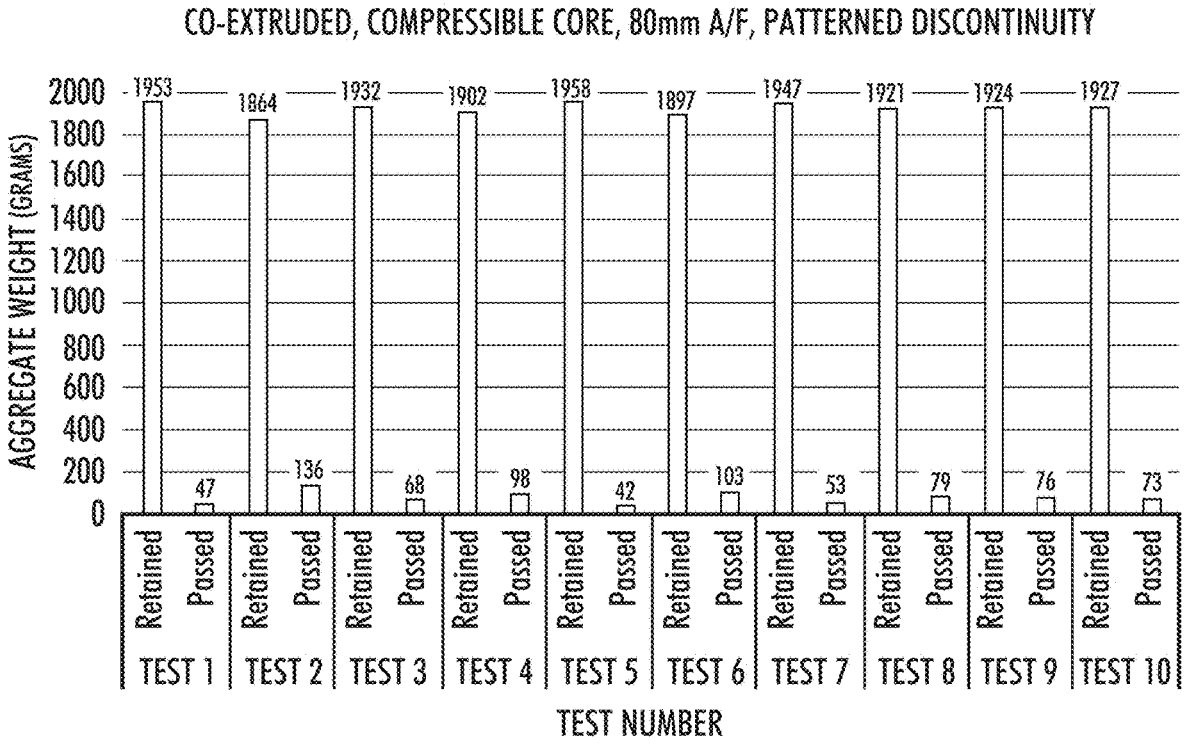
FIG. 2A is a chart illustrating examples of testing with brush over for fine aggregate in the triangle or triaxial geogrid having a plurality of strong axes with patterned discontinuities.
Figure 2B:
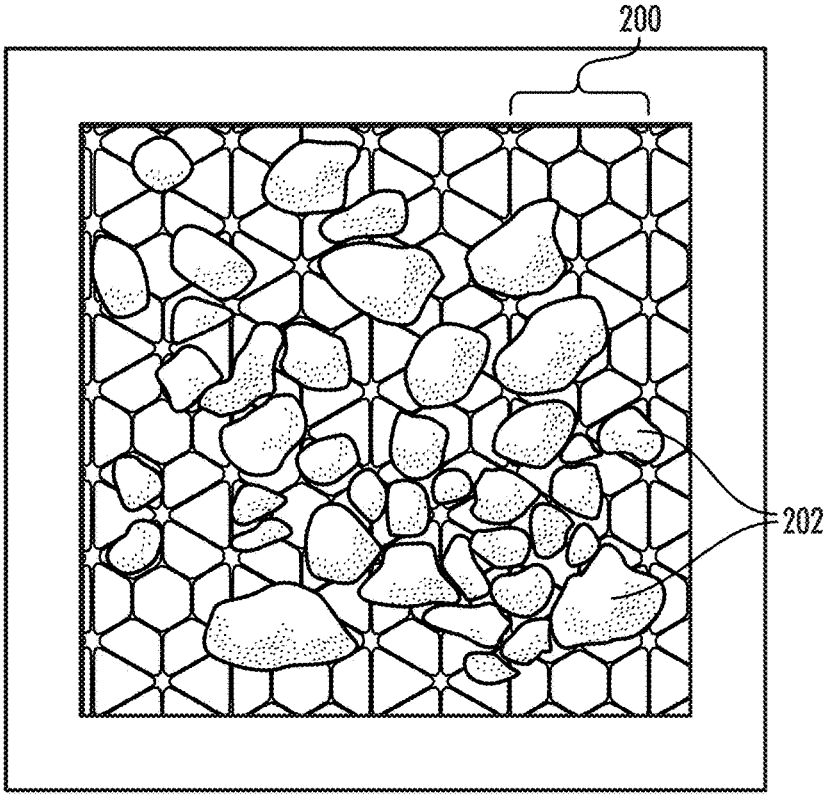
FIG. 2B is an example illustrating the results of brush over testing with fine aggregate of the triangle or triaxial geogrid with patterned discontinuities and a plurality of strong axes.

Referring now to FIGS. 2A-D. In FIG. 2A, a chart illustrating examples of testing with brush over for fine aggregate in the exemplary horizontal mechanically stabilized geogrid with a hexagonal geogrid and patterned discontinuities. FIG. 2B is an example illustrating the results of brush over testing with fine aggregate 202 of the triangle or triaxial geogrid 200 with patterned discontinuities and a plurality of strong axes.

Figure 2C:
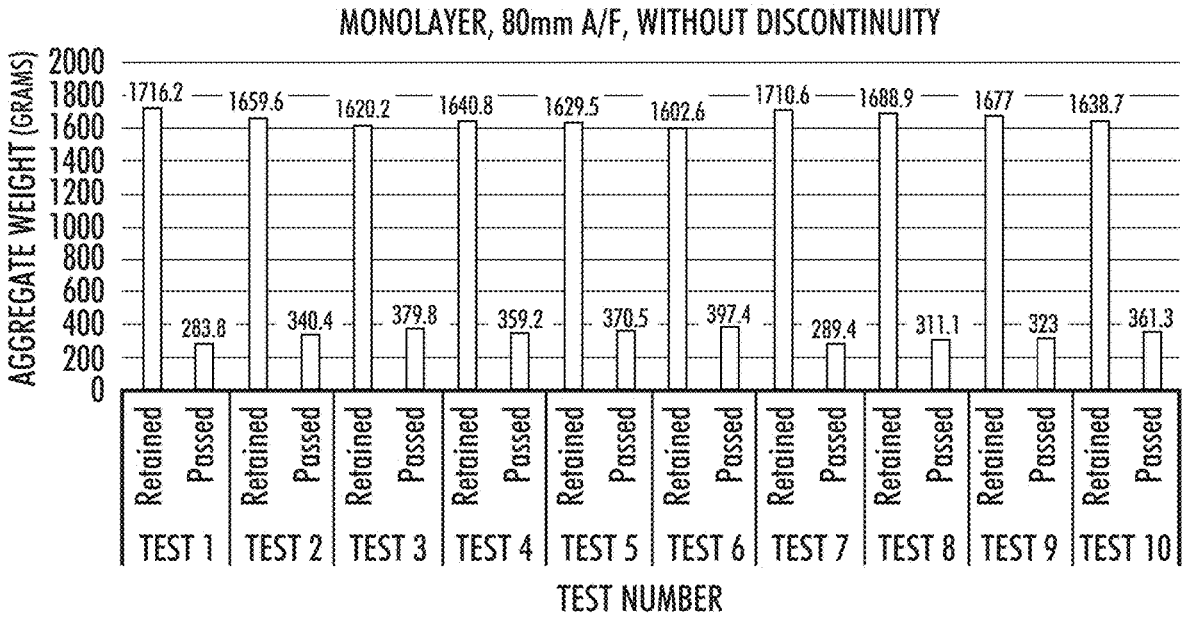
FIG.2C PRIOR ART
FIG. 2C is a chart illustrating examples of testing with brush over for fine aggregate in the triangle or triaxial geogrid without patterned discontinuities or a plurality of strong axes.

FIG. 2C is a chart illustrating examples of testing with brush over for fine aggregate 202 in the triangle or triaxial geogrid without hexagonal geometry and without patterned discontinuities 200. The testing data covering the example embodiments compares a triangular geometry that includes a pattern of discontinuities over that of a triangle geometry without such discontinuities, and demonstrates the significant increase in retained particles with brush-over testing. The horizontal mechanically stabilizing geogrid that contains a pattern of discontinuities confines and traps particles during placement, is more compliant to beneficial interparticle lateral movement during compaction, and is thus more resistant to horizontal movement after compaction. This embodiment excels in standardized testing such as brush over testing without the addition of a compressible cellular layer.

Figure 2D:
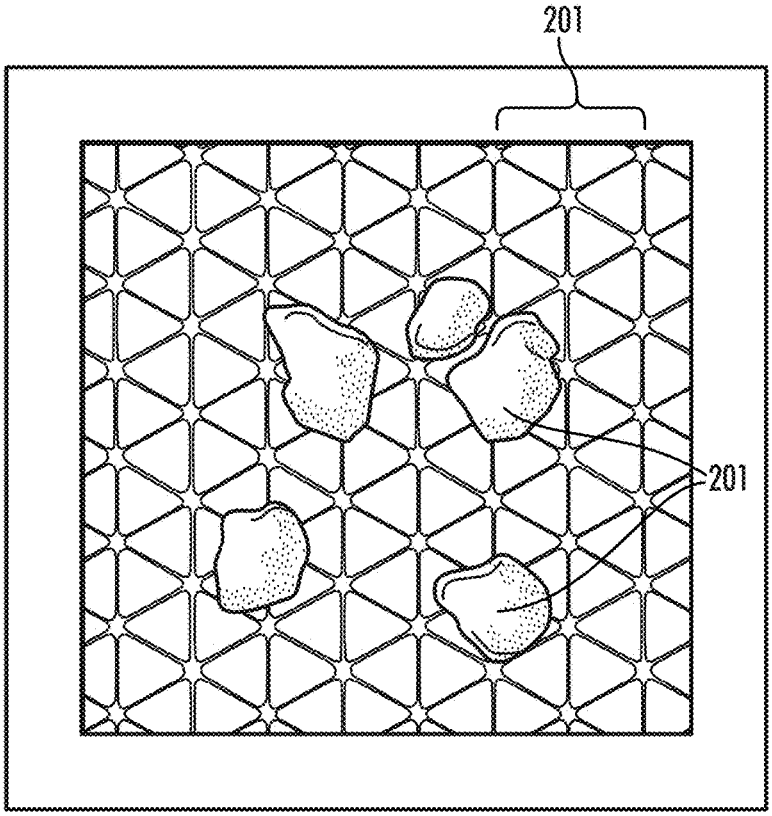
FIG.2D PRIOR ART
FIG. 2D is an example illustrating the results of brush over testing with fine aggregate of the triangle or triaxial geogrid without patterned discontinuities and without a plurality of strong axes.

FIG. 2D is an example illustrating the results of brush over testing with fine aggregate 202 of the triangle or triaxial geogrid without patterned discontinuities 201 and without a plurality of strong axes. The example discloses that uniform voids do not trap as well as the patterned discontinuity. Wherein the patterned discontinuity provides for trapping of a variety of sizes and shapes of aggregate and soil. The brush over testing is performed utilizing a standard uniform brush, wherein aggregate is placed on a geogrid, the geogrid is placed on top of a bin. The test proceeds by the brush making repeated swipes across the aggregate. After a series of brush overs, the remaining aggregate is quantified. In one example, the aggregate placed on the test subjects is the same aggregate, and the passed value is the value located in the bin, wherein the retained value is the bin value subtracted from the total aggregate measured. As such the brush over test provides an experimental view into geometry and how well the various improvements disclosed herein perform over prior art.

Figure 3A:
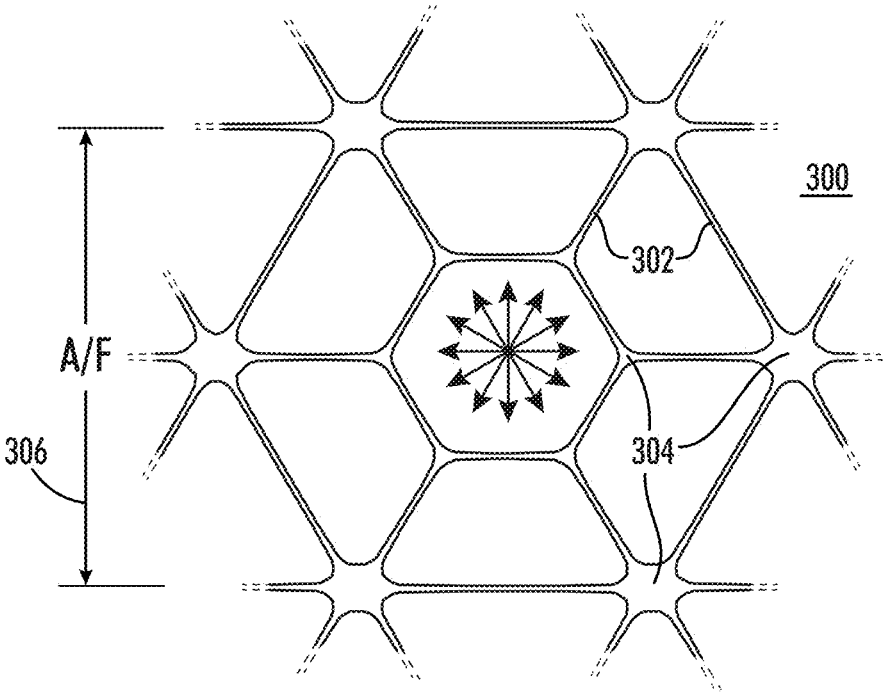
FIG. 3A illustrates an example of confinement elements, including ribs and nodes, of a triangle or triaxial geogrid with patterned discontinuity and a plurality of strong axes.
Figure 3B:
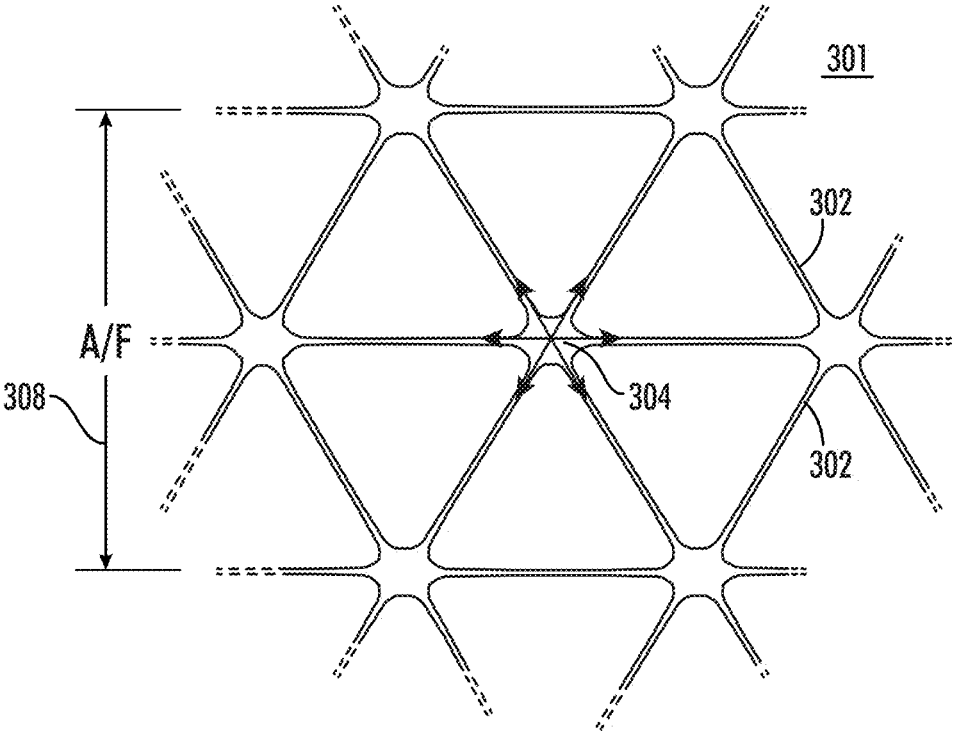
FIG. 3B PRIOR ART
FIG. 3B illustrates an example of confinement elements, including ribs and nodes, of a triangle or triaxial geogrid without a plurality of strong axes (Prior Art)

Referring now to FIGS. 3A-B. FIG. 3A illustrating an example of confinement elements, including ribs 302 and nodes 304, of the exemplified horizontal mechanically stabilized geogrid 300 with hexagonal geometry and patterned discontinuity. FIG. 3B illustrating an example of confinement elements, including ribs 302 and nodes 304, of a triangle or triaxial geogrid pattern without discontinuity 301 (Prior Art). In this example, the exemplified hexagonal geometry provides twice the confinement element capacity, wherein the increase in ribs 302 provides additional surface area for confining particulate and substrate after compaction. This confinement is realized through the confinement element capacity, but also through a heightened aspect ratio. The results may further be improved upon by adding a compressible cellular layer to the ribs and nodes, and further by increasing surface roughness of the ribs and nodes. Further, the post-compaction confinement provides resistance against radial loading motion, such as trafficking, and aids in compaction, providing concentric-like resistance to aggregate movement.

As illustrated in FIGS. 3A-B, the force vectors along the triaxial without patterned discontinuities trap aggregate based on specific apertures, while also maintaining rigidity across the strong axes. Whereas the present disclosure has varying aperture sizes, including three geometrical features, a trapezoid, a triangle, and a hexagon, for improved aggregate collection and compaction. The across flats or ('A/F') dimension is further disclosed, wherein the A/F is a distance measurement utilized to signify a distance within the geogrid. With regard to the patterned discontinuity, the A/F distance 306 is the outer hexagon. With regard to triaxial without patterned discontinuity, the A/F distance 308 is the only hexagon formed. From FIG. 3A the force vectors are displayed, showing dispersion across the whole of the inner hexagon, and radiating uniformly to the outer hexagon, thus spreading the forces across the whole of the example.

Figure 4A:
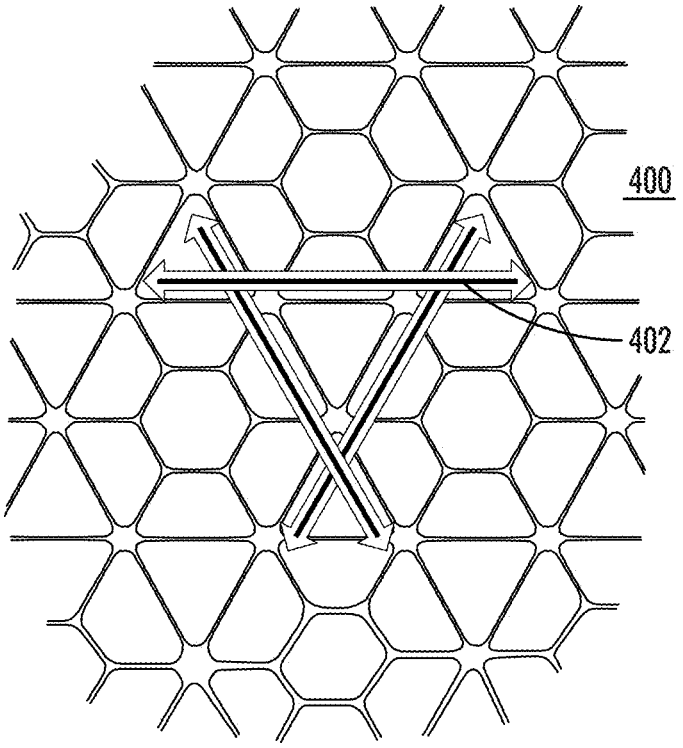
FIG. 4A illustrates an example force vectors of a triangle or triaxial geogrid pattern that includes patterned discontinuities and a plurality of strong axes.
Figure 4B:
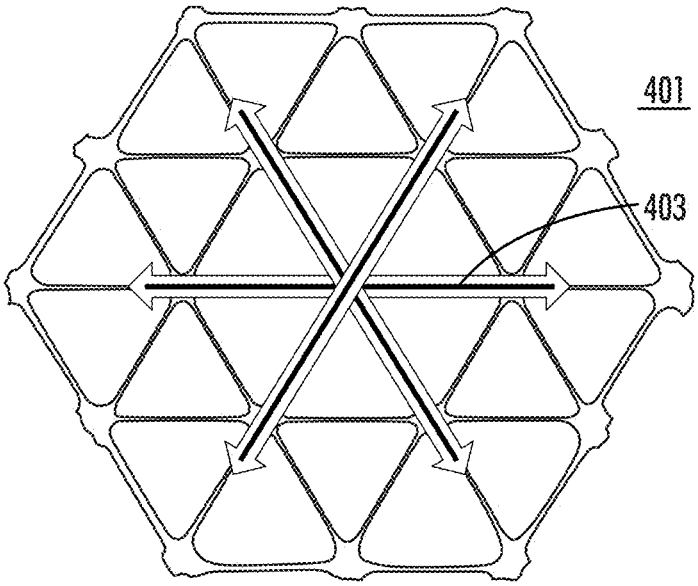
FIG.4B PRIOR ART
FIG. 4B illustrates an example of force vectors of a triangle or triaxial geogrid pattern that does not include patterned discontinuities or a plurality of strong axes (Prior Art)

Referring now to FIGS. 4A-B. In FIG. 4A, an illustration of example force vectors of a triangular geogrid pattern containing a pattern of discontinuities 400, illustrating the plurality of strong axes 402 that run throughout the integral geogrid, and spread the force out event throughout the geogrid, thus improving trafficking while in the geotechnical environment. FIG. 4B discloses an illustration of example force vectors of a triangle or triaxial geogrid without patterned discontinuities 401, and lacking a plurality of strong axes 403. The exemplary hexagonal structure provides multidirectional support along the strong axis ribs, referred to herein as along the plurality of strong axes 402. The triaxial without patterned discontinuity has fewer structures in which to dissipate the forces from, for example, trafficking. Therefore, the geometry of a horizontal multilayer mechanically stabilized geogrid 400, with patterned discontinuity allows for dissipation of forces through a plurality of strong axes 402 that further increases geogrid stability and resilience within the geotechnical environment.

Figure 5:
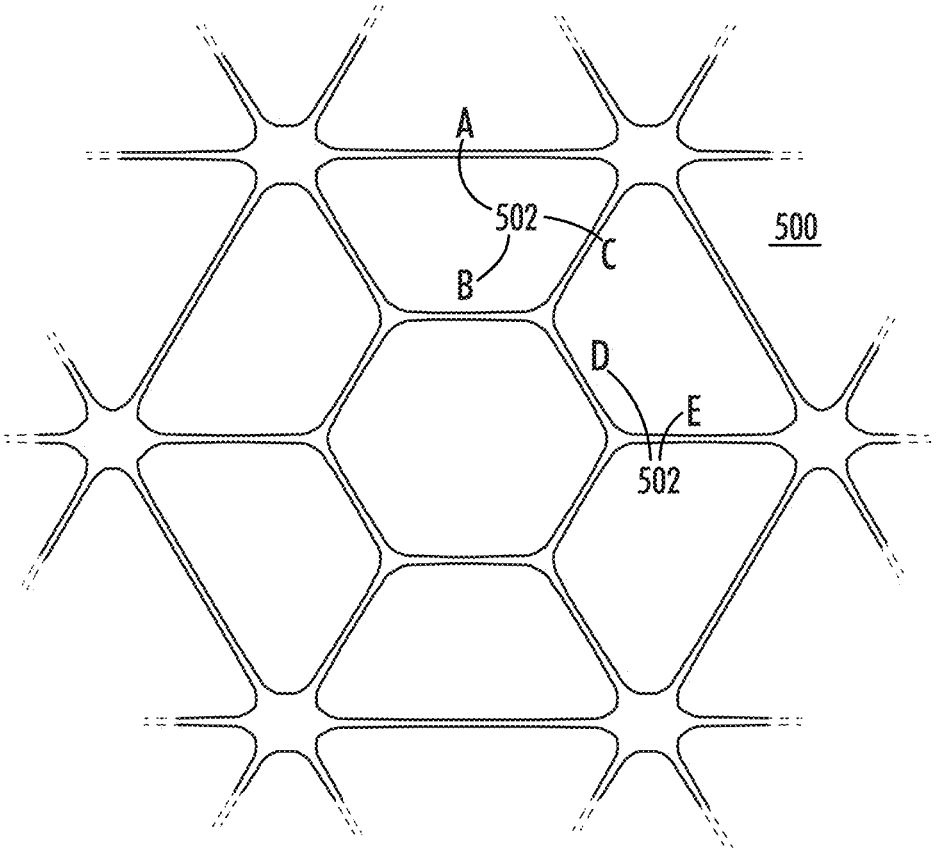
FIGS. 5 and 6A-B illustrate an example of aspect ratios along various ribs and nodes, derived from a triangle or triaxial geogrid with patterned discontinuities and a plurality of strong axes and a triangle or triaxial geogrid without patterned discontinuities.
Figures 6A, 6B:
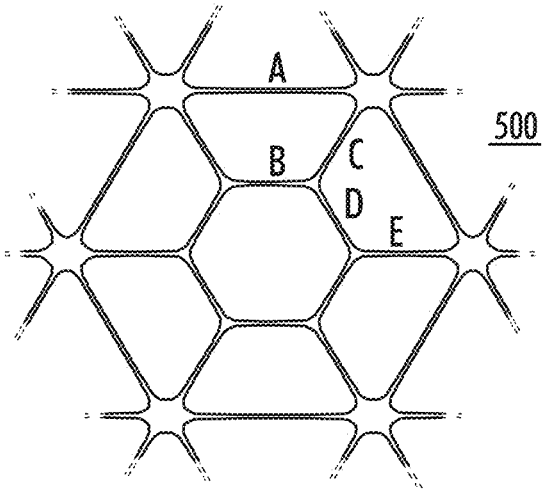

FIGS. 5 and 6 illustrate an example of aspect ratios along various ribs and nodes, derived from a triangle or triaxial geogrid with patterned discontinuities and a plurality of strong axes 500 and a triangle or triaxial geogrid without patterned discontinuities 501. Ribs 502 indicated by A-E depict the trapezoidal interiors wherein, in one example, is the basis for confinement of aggregate and soils. Further, the chart in FIG. 6 illustrates the rib height aspect ratio 604 across the disclosure and prior art embodiments. The chart further illustrates the additional benefits of the compressible cellular layer, wherein the foam or particular matter increases aspect ratio and decreases the use of polypropylene, making a better performing, more environmentally friendly alternative to existing geogrids.

In the present embodiment of FIGS. 5 and 6, the polymeric exterior is above and below a core of compressible cellular material, also referred to as a compressible cellular core, and in one aspect, the compressible cellular material may be comprised of $CaCO_3$. In other aspects it may be another fibrous material or an engineered foaming agent, that creates as compressible cellular layer. According to the example of compressible cellular material, depending upon the service application in which the geogrid is placed, such compressible cellular particulate material, such as particulate filler, may include one or more of $CaCO_3$ (calcium carbonate), hydrous magnesium silicates (talc), $CaSiO_3$ (wollastonite), calcium sulfate (gypsum), diatomaceous earth, titanium dioxide, nano-fillers (such as nano clay), multi-wall carbon nanotube, single carbon wall carbon nanotube, natural or synthetic fibers, metal fibers, glass fibers, dolomite, silica, mica, and aluminum hydrate. With regard to the foaming agent example, a mix of a chemical foaming agent is mixed with a polymer that is extruded to form a compressible cellular layer, wherein the heat from the extrusion process melts the polymer and decomposes the foaming agent, which liberates it of gas, forming the compressible cellular layer. Any foaming agent that incorporates with polypropylene and produces the desired effects may be used, in one example products made and manufactured by Bergen International™ may be used. In one example, a melt flow rate index ASTM D1238-20, and in another example ASTM D4218-20 is utilized.

Figure 7:
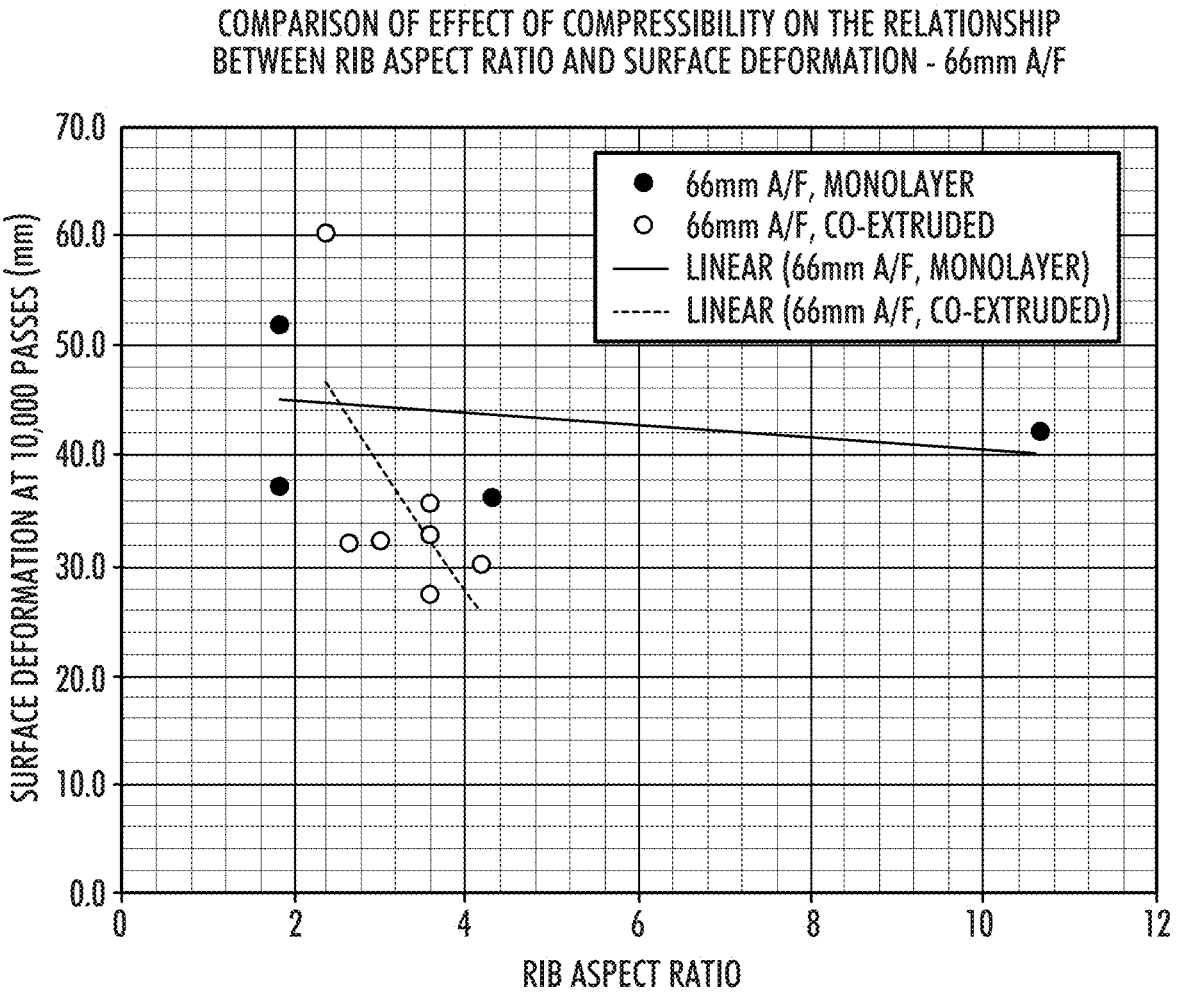
FIG. 7 is a chart illustrating a comparison of monolayer versus co-extruded triangle or triaxial geogrid as they undergo 10,000 trafficking passes, depicting a benefit in co-extrusion of the material.

Referring now to FIG. 7, a chart illustrating a comparison of monolayer versus co-extruded triangle or triaxial geogrid as they undergo 10,000 trafficking passes. This example depicts an observable benefit in co-extrusion of the material to form an integral geogrid. In this example the chart depicts potential benefits in co-extrusion over that of the prior art monolayer, additionally, the co-extruded structure depicts benefits in terms of the relationship between overall surface deformation and rib aspect ratio. The chart indicates that a co-extruded geogrid is capable of obtaining a lower surface deformation without resorting to high aspect ratio. In this example, testing criteria notes that a 66 mm length across the flat dimension of the sampled geogrids (See FIGS. 3A-B) is difficult to compare across a wide range of aggregates.

Figure 8:
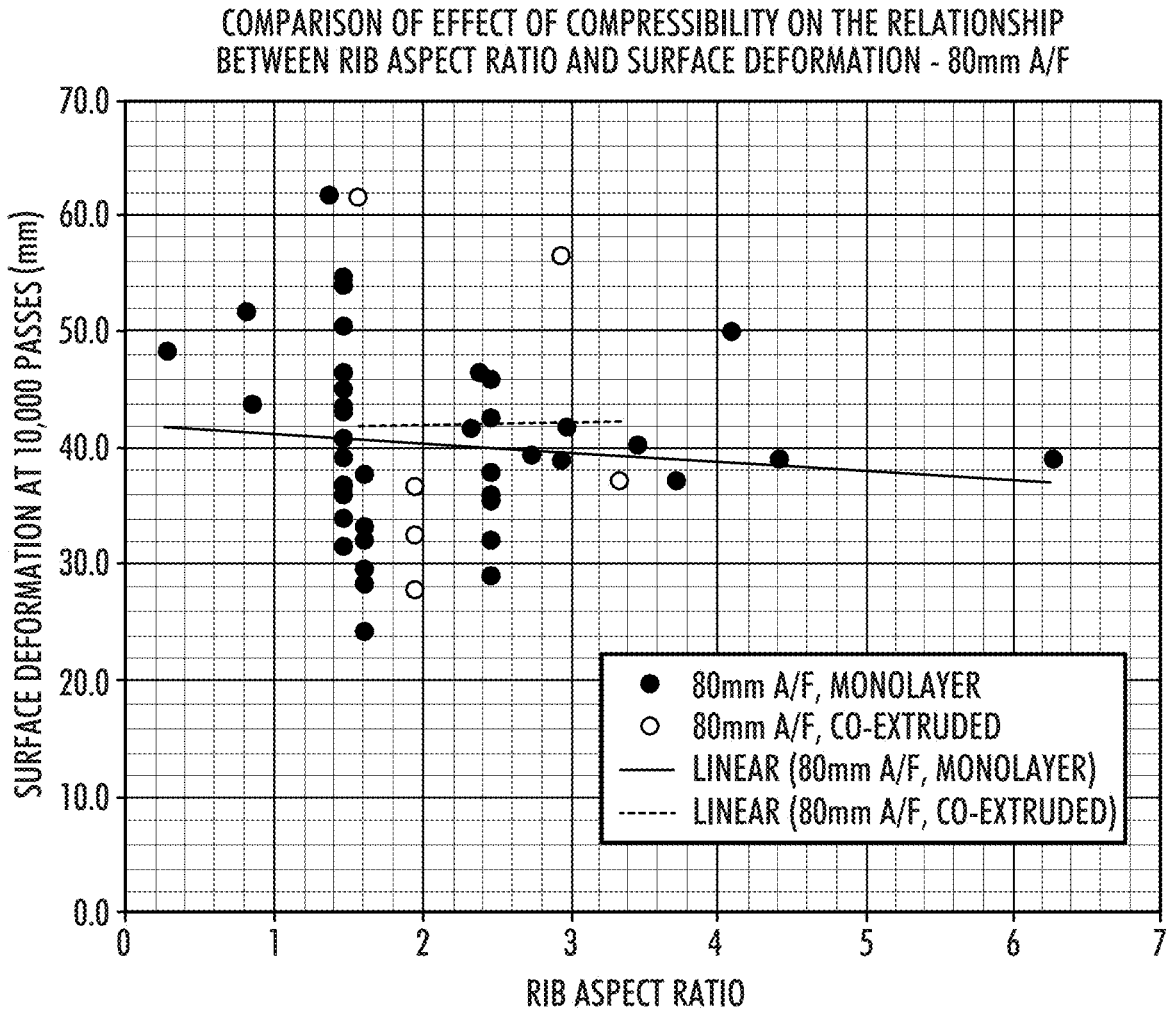
FIG. 8 is a chart illustrating a comparison of monolayer versus co-extruded triangle or triaxial geogrid as they undergo 10,000 trafficking passes, depicting that there is not always a benefit in co-extrusion, that both material properties and geometry in combination play an important role.

Referring now to FIG. 8, a chart illustrating a comparison of monolayer versus co-extruded triangle or triaxial geogrid as they undergo 10,000 trafficking passes, depicting that there is not always a benefit in co-extrusion, and that both material properties and geometry in combination play an important role. In this example, a more standard geogrid dimension of 80 mm across the flat dimension (See FIGS. 3A-B for dimensionality example), wherein the results indicate less of a benefit with co-extruded. The conclusion of this example is that there is benefit in both material properties (monolayer, co-extruded), as well as geometry (60 mm A/F, 80 mm A/F).

Referring now to FIG. 9, illustrating an example comparison of rib aspect ratio depicting diminished returns for both geometries of triangle or triaxial geogrid with patterned discontinuities and a plurality of strong axes and a triaxial geogrid without discontinuities and without a plurality of strong axes as they undergo 10,000 trafficking passes. In the example, the monolayer samples of triangle or triaxial geogrids, one with patterned discontinuities, and one without, illustrate rib aspect ratio and surface deformation. In the example the patterned discontinuities and strong axes allow for an increase in confining elements and improved results in surface deformation. The benefits of the present disclosure, and illustrated in FIG. 9, over that without patterned discontinuity include integral junctions, includes a combination of three different shapes and sizes for confining a variety of aggregates that create a "snow shoe" effect, and continuous ribs in three directions for grid strength. These benefits over the prior art allow for varying dimensional properties for the confining elements, varying mechanical properties for the confining elements, and varying mechanical properties at the macro level, such as in plane and out of plane stiffness due to a combination of minor or major integral junctions.

Figure 10:
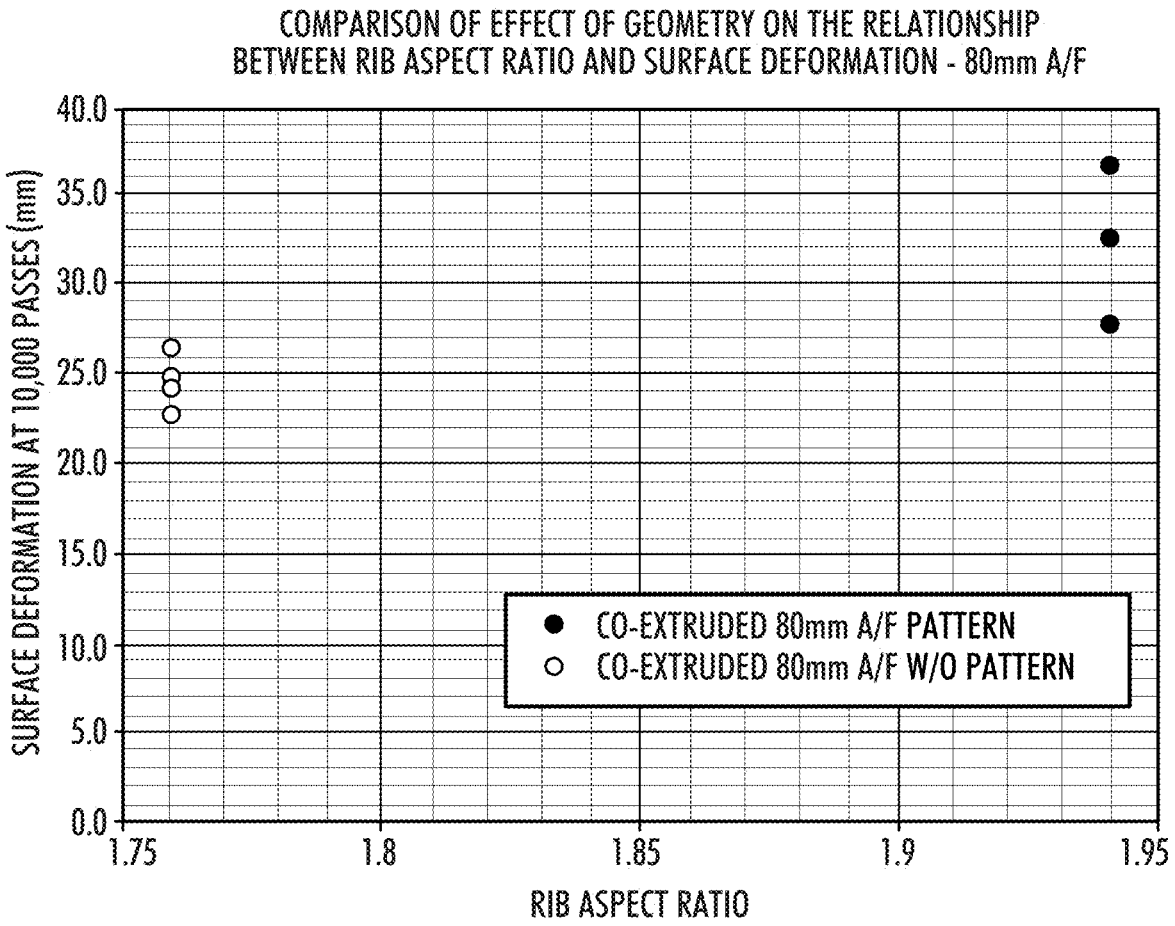
FIG. 10 illustrates an example comparison of the effect of geometry on the relationship between rib aspect ratio and surface deformation of triangle or triaxial geogrid with patterned discontinuities and a plurality of strong axes versus a triaxial geogrid without discontinuities and without a plurality of strong axes as they undergo 10,000 trafficking passes.

Referring now to FIG. 10 illustrates an example comparison of the effect of geometry on the relationship between rib aspect ratio and surface deformation of triangle or triaxial geogrid with patterned discontinuities and a plurality of strong axes versus a triaxial geogrid without discontinuities and without three strong axes as they undergo 10,000 trafficking passes. FIG. 10 indicates the benefits of reduced surface deformation from a geometry perspective. In the example, both samples are co-extruded, with one sample possessing the triangle or triaxial geometry of strong axes and patterned discontinuities, and the other lacking the strong axes and patterned discontinuities. The strong axes and patterned discontinuities geometry, as disclosed herein is also referred to as hexagonal geometry. The resulting chart indicates a lower surface deformation with a lower rib aspect ratio, thereby having the strong axes with patterned discontinuity, having lower aspect ratio ribs, providing reduced surface deformation.

Figure 11:
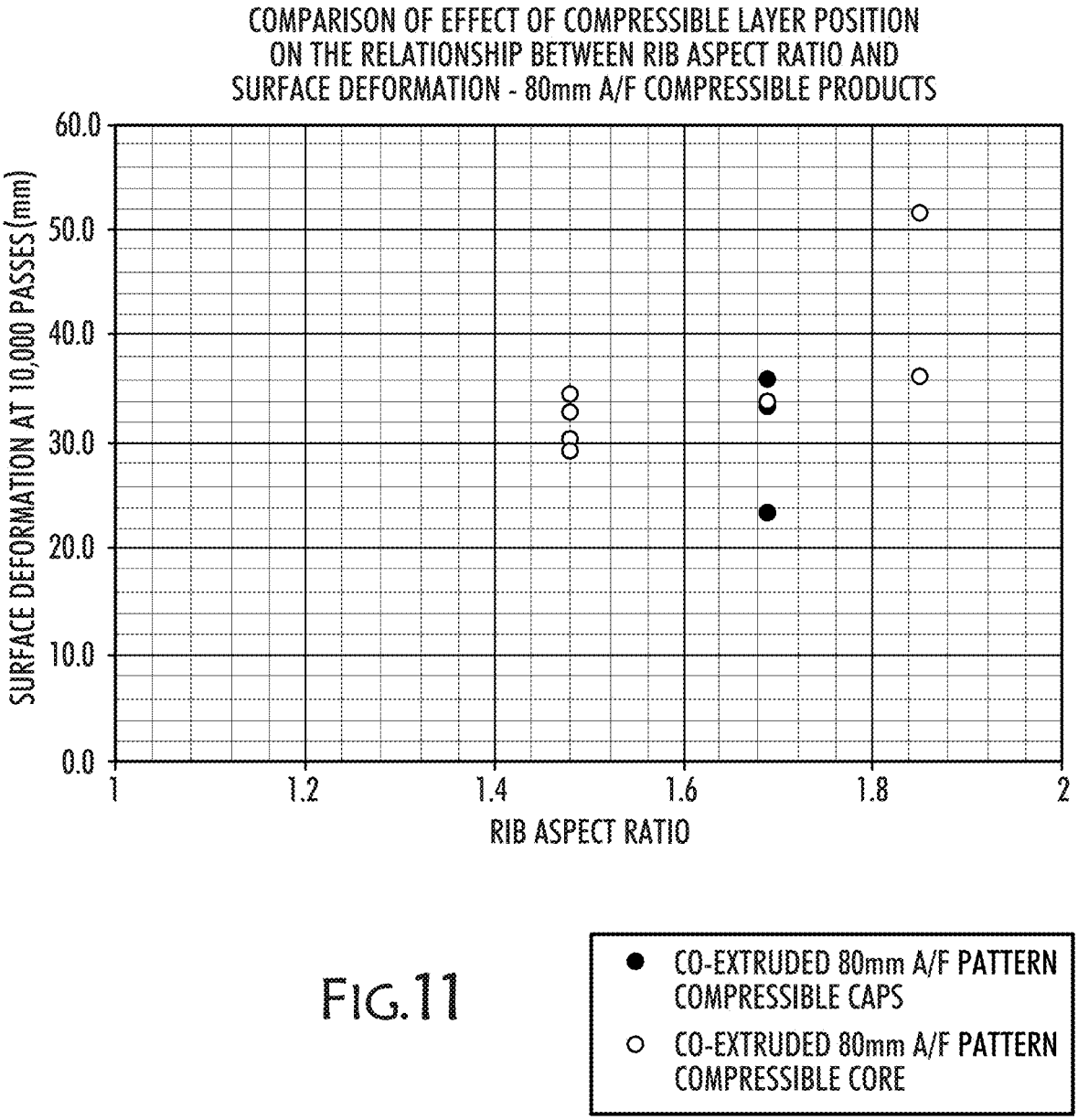
FIG. 11 is a chart that illustrates example trafficking performance of similar geometry of a triangle or triaxial geogrid having patterned discontinuities and a plurality of strong axes, wherein testing of embodiments having the compressible cap cellular layer versus that of having a compressible core cellular layer, depicting the compressible cap layer having better performance.

Referring now to FIG. 11, a chart that illustrates example trafficking performance of similar geometry of a triangle or triaxial geogrid having patterned discontinuities and a plurality of strong axes, wherein testing of embodiments having the compressible cap cellular layer versus that of having a compressible core cellular layer, depicting the compressible cap layer having better performance. In one aspect, the triangle or triaxial geometry with strong axes and patterned discontinuities has been co-extruded and comprises a core of polymeric material, and is further capped with a compressible cellular layer (referred to in FIG. 11 as Compressible Caps). In the other aspect, the triangle or triaxial geometry with strong axes and patterned discontinuities is co-extruded and has a core of compressible cellular material, and is capped with a polymeric sheet or layer (referred to in FIG. 11 as Compressible Core). In this example, the addition of a compressible cellular layer increases the nesting as well as the rib aspect ratio, while reducing the usage of a polymer. The chart indicates improvement in surface deformation with the compressible cap aspect, over that of the compressible core. The results were identified, through experimentation and testing, that the compressible cap adds surface roughness that increases aggregate and soil friction and interaction.

Figure 12:
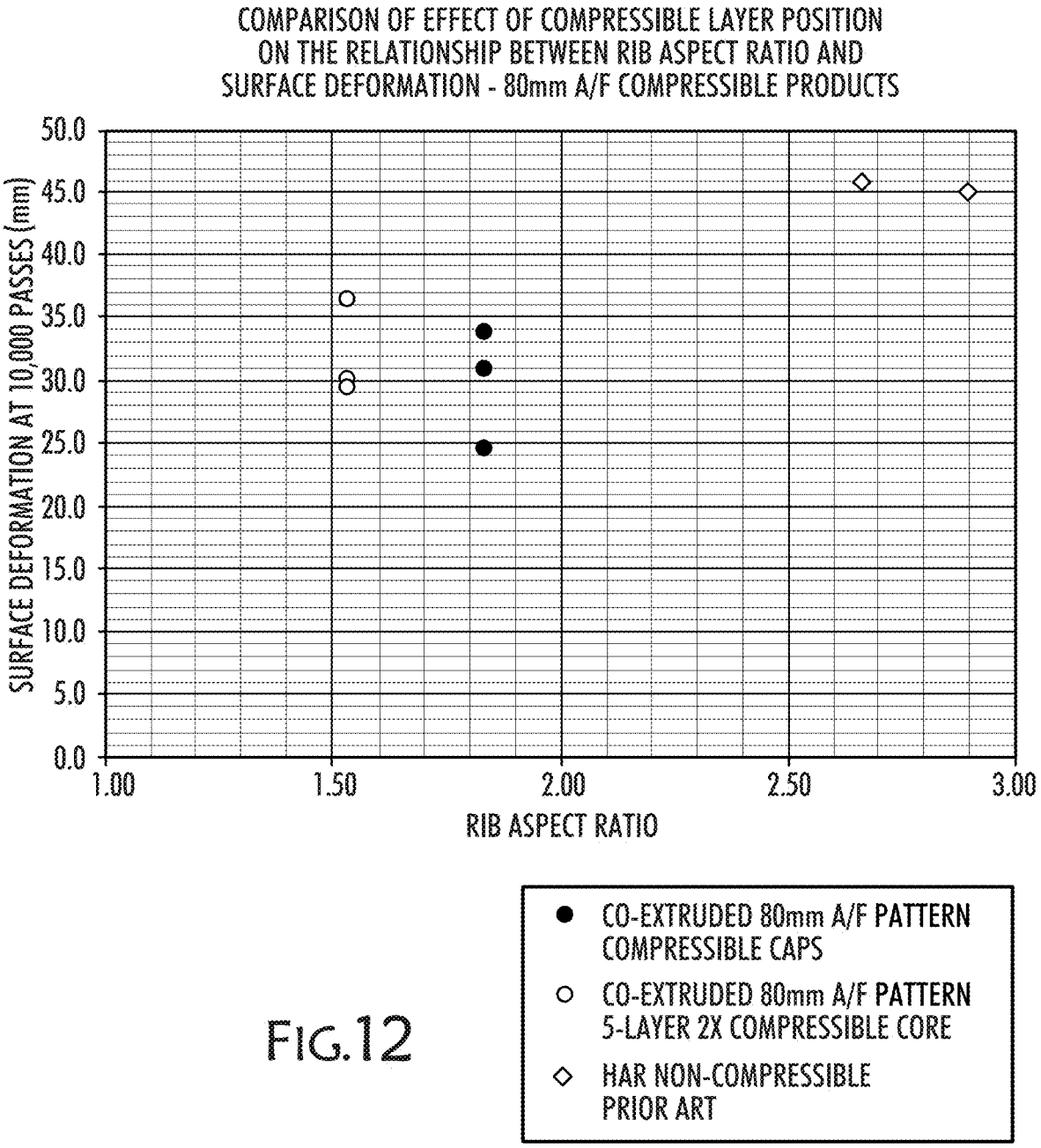
FIG. 12 is a chart illustrating examples on the effects of compressible layer position and rib aspect ratio as it relates to surface deformation in geometry of a triangle or triaxial geogrid having patterned discontinuities and a plurality of strong axes with a compressible cap cellular layer and a compressible core cellular layer.

Referring now to FIG. 12, is a chart illustrating examples on the effects of compressible layer position and rib aspect ratio as it relates to surface deformation in geometry of a triangle or triaxial geogrid having patterned discontinuities and a plurality of strong axes with a compressible cap cellular layer and a compressible core cellular layer. The results of the example chart indicate that both embodiments including a compressible cellular layer have a lower rib aspect ratio, thus requiring less polymeric material, and perform similarly. Whereas the high aspect ratio non-compressible prior art has little surface deformation, which does not allow for compaction and locking in of aggregate and soils, and further requires more polymeric material and cost to increase rib height.

Figure 13:
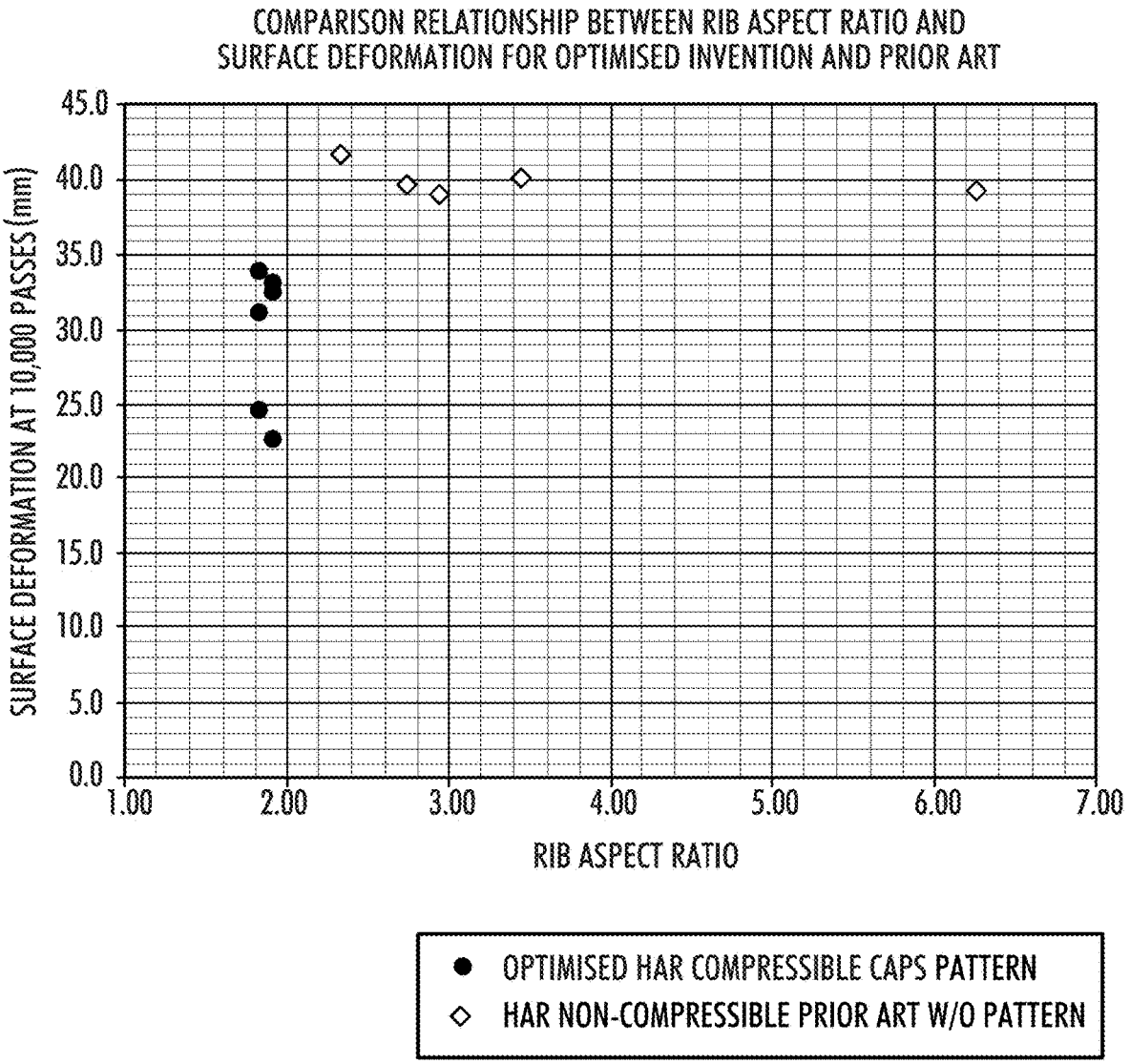
FIG. 13 is a chart that illustrates the benefits of optimized geometry of a triangle or triaxial geogrids with the addition of pattern discontinuities and a plurality of strong axes and the addition of collapsible caps over that of the prior art high aspect ratio and non-compressible caps cellular layer triangle or triaxial geogrid without patterned discontinuities.

Referring now to FIG. 13, a chart that illustrates the benefits of optimized geometry of a triangle or triaxial geogrid with the addition of pattern discontinuities and a plurality of strong axes and the addition of collapsible caps over that of the prior art high aspect ratio and non-compressible caps cellular layer triangle or triaxial geogrid without patterned discontinuities. In this example a non-compressible monolayer geogrid is compared to a triaxial geogrid with patterned discontinuities and strong axes to demonstrate the improvements that geometry and a compressible cellular layer provide. The non-compressible monolayer, in the example, contains a high aspect ratio ('HAR'), so as to focus the testing on the geometry and the compressible cellular layer. Trafficking results show a dramatic decrease in rib aspect ratio and performance as compare to the monolayer with high aspect ratio. Therefore, the combination of a triangle or triaxial geometry with patterned discontinuities and a plurality of strong axes, coupled with the compressible cellular layer, outperforms the triangle or triaxial geometry without patterned discontinuities, and with a high aspect ratio. The results indicate material savings as rib aspect ratio is decreased, and performance is increased, thus resulting in environmental and cost savings with the configuration as outlined in FIG. 13. The results further indicate that rib aspect ratio between the single layer and the multilayer were similar, indicating the performance increase is relative to the compressible cellular layer, wherein the voids trap aggregate and retain structure over a longer duration of trafficking. Further, the deformation is less severe, producing optimal aggregate confinement and lateral restraint for stabilizing the geotechnical environment and providing a longer trafficking lifecycle.

Figure 14A:
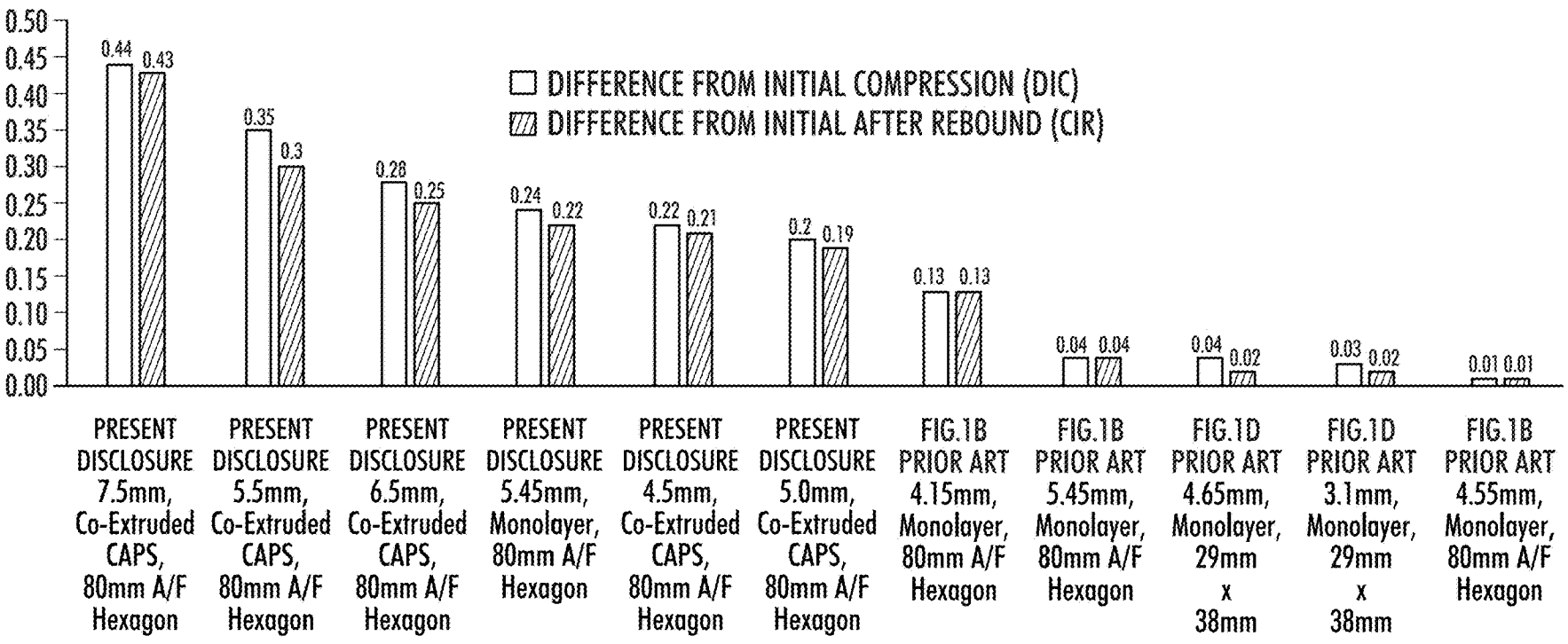
FIG. 14A is a chart illustrating an example of improvements of the triangle or triaxial geometry with a plurality of strong axes and patterned discontinuities, along with a compressible cellular layer, versus prior art examples, indicating of several geogrids performance improvements observed in compression testing.

Referring now to FIG. 14A, a chart illustrating an example of improvements of the triangle or triaxial geometry with a plurality of strong axes and patterned discontinuities, along with a compressible cellular layer, versus prior art examples, indicating of several geogrids the performance improvements observed in compression testing. Compression testing, an example hereof is disclosed in FIG. 14C, employs an apparatus, such as a probe, to place a force on the tested geogrid, then measures the amount of force to fully compress. In this example both the compressibility and the rebound ability of the integral geogrid examples were tested. As observed in the chart, having a layer with a cellular structure, i.e., co-extruded, or compressible core and compressible caps, has substantially greater performance over the samples not having a layer with a cellular structure, i.e., monolayer, polymeric material only. Wherein this example the co-extruded examples comprise a compressible cellular layer that is comprised of a foaming agent. Further, the disclosure of a soft foam and a hard foam allow for varying compressibility, and usage is determined by the geotechnical environment. In other examples the compressible cellular layer may be formed from a particulate filler.

Referring now to FIG. 14B, a chart illustrating an example of compressibility in mm at 125 N force with an example of triangle or triaxial geometry with a plurality of strong axes and patterned discontinuities, along with examples of prior art geogrids. The results here are from an apparatus that subjects concentrated force onto the respective examples, in one embodiment the force is from a large pin device that targets concentrated force on the geogrid, the results are then measured as a result of compressibility. The apparatus employs a 1.6 mm wide metal probe and the application of a 125 N force to compress the integral geogrid specimens. As shown in FIG. 14B, the compressibility of the integral geogrid specimens having a layer with a cellular structure according to the present disclosure, i.e., compressible caps, is substantially greater than that of the specimens not having a layer with a cellular structure, i.e., monolayer.

Referring now to FIG. 14C, an example apparatus for conducting compression testing and deriving the data in FIG. 14A-B. In the example a probe 1400 is forced into a sample geogrid 1402 or specimen. In one aspect, the test is performed under ASTM D695 for compressive strength per unit area. The result is a compressive yield strength measured at the point of permanent yield, zero slope, on the stress-strain curve. The ultimate compressive strength is the stress required to rupture a specimen, materials such as polypropylene that does not rupture may have results that are reported as specific deformation such as 1%, 5%, or 10%. In the example of FIG. 14C, the resulting force compresses the geogrid 1404, wherein the amount of compression is measured and tabulated, as disclosed in FIGS. 14A-B. Compressibility within the compressible cellular layer provides soil and aggregate trapping, along with other improvements disclosed herein. Within the geotechnical environment, compressibility allows for better lateral restraint, and allows for further compaction of soils and aggregate.

Figures 15A, 15B:
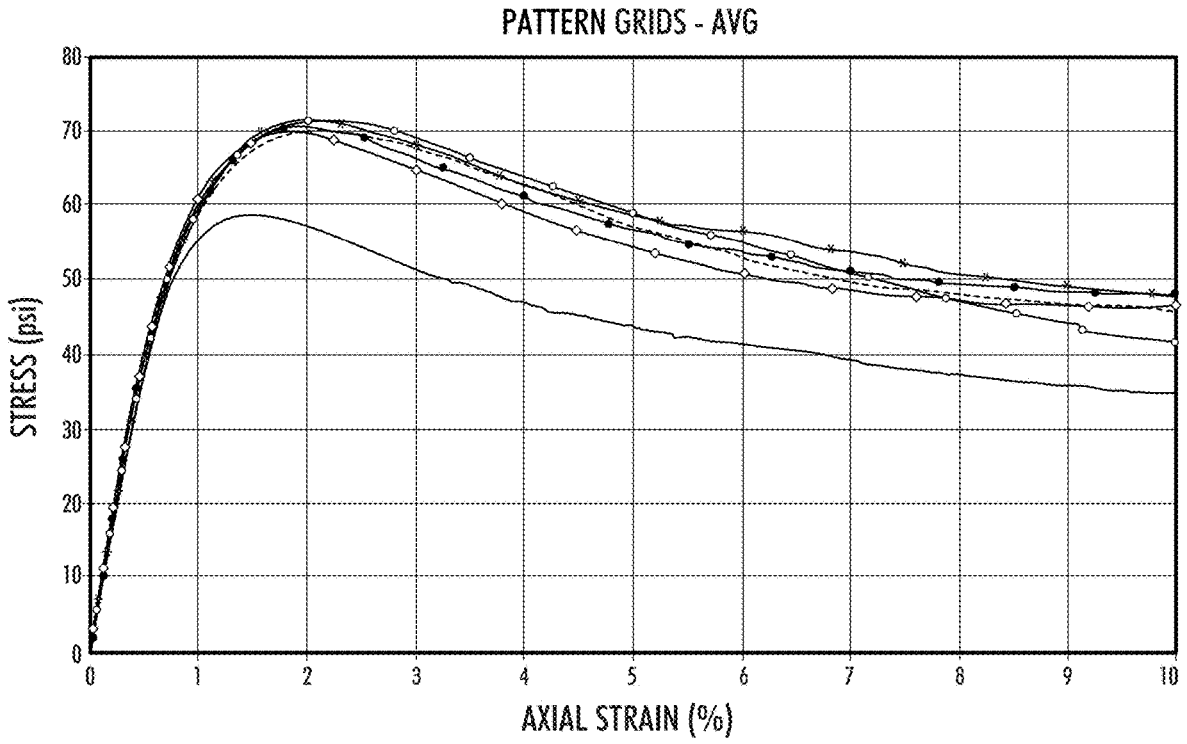
FIGS. 15A-B is a chart illustrating a comparison of example embodiments of triangle or triaxial geometry with engineered pattern discontinuities and a plurality of strong axes versus a control of a triangle or triaxial geometry without pattern discontinuities or a plurality of strong axes.

Referring now to FIG. 15, a chart and table illustrating example embodiments herein, depicting nominal loss in stiffness and/or strength when testing multilayer geogrids with hexagonal geometry, that is geometry that is triangle or triaxial with patterned discontinuities and a plurality of strong axes, made with a compressible cellular layer. Further, the testing results indicate a reduction in polymeric material only nominally alters the stiffness of the geogrids sampled. Therefore, adding a compressible cellular layer carries the benefits of aggregate confinement, production cost reduction, and environmental benefits without sacrificing the strength provided by the polymeric material. Further, the geometric advancements disclosed herein, of patterned discontinuities and a plurality of strong axes provide integral joints, and varying shapes for trapping aggregate and soil.

Referring now to FIG. 16A, an illustration of an example polymeric triangle or triaxial geogrid without patterned discontinuities or a plurality of strong axes (Prior Art), and FIG. 16B-C, illustrating an example of a triangle or triaxial geogrid with a plurality of strong axes and engineered pattern discontinuities. In the example of FIGS. 16B-C, the polymeric material is positioned on the top and the bottom of a compressible cellular layer, referred to herein as a compressible cellular core or compressible core, and illustrates within the chart of FIG. 16C the geometry differences. Wherein in this example, the geometry including discontinuities, has 20% less un-oriented nodes, and 56% more oriented tensile elements, per square meter of geogrid. The un-oriented nodes and more oriented tensile elements contribute to increased trafficking resistance and better aggregate confinement, as provided in the geometry testing examples provided in FIG. 10.

Continuing with FIGS. 16A-C, in one aspect, according to the sample data, the exemplified hexagon geometry, also referred to as triangle or triaxial geometry with patterned discontinuities, or a horizontal mechanically stabilized geogrid 1602, allows a basket or snow shoe to form during aggregate compaction. This basket is formed from the unique geometry of a larger outer hexagon, and a small, inner hexagon, wherein the out hexagon is typically made with a thicker polymeric aspect ratio, and the inner hexagon being more pliable and with a thinner polymeric aspect ratio. According to the present example, the basket or snow shoe thereby increases the surface area of the ribs (via compressible cellular layer), as well as increases the amount of contact with the aggregate (surface roughness and contact via the compressible cellular layer).

In further aspects, the nodes on the outer hexagon (see FIG. 4A) provide stability with a plurality of strong axes, while allowing nesting and compaction to occur with amore pliable inner hexagon. The nodes, as they are referred to in this example, are the points where ribs intersect and in one example have a high aspect ratio. The nodes of the outer hexagon are enlarged and impart stiffness, while the inner exemplified hexagon nodes are reduced allowing some pliability to capture and settle in aggregate (see FIG. 4A). The forces and functions work in various ways; first, the integral nodes allow for rigidity and stiffness; second, the different shapes formed from the patterned discontinuities allow trapping of various aggregate and soils, as well as reduction in lateral movement. Other advantages, such as the benefit of co-extrusion over monolayer, and the additional of a compressible cellular layer, further advance the trapping and compaction of aggregate, resulting in improved soil retention. As depicted in the results of FIGS. 7-13, the patterned discontinuities and a plurality of strong axes, coupled with the compressible cellular layer, and high rib aspect ratio, provide enhancements beyond the prior art as well as testing and validation results.

Figure 17A:
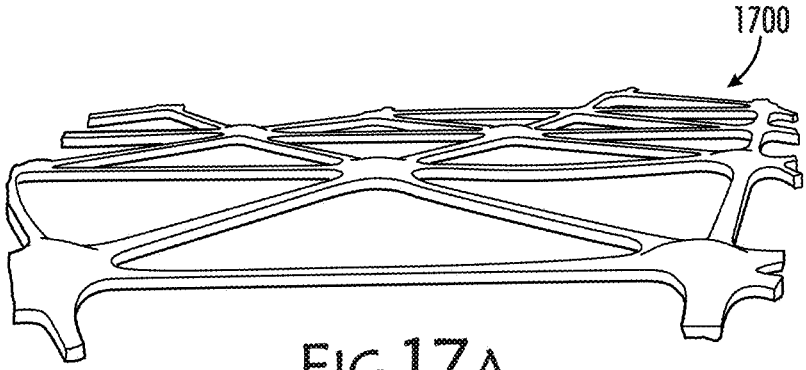
FIG.17A PRIOR ART
FIG. 17A is an illustration of an example polymeric triangle or triaxial geogrid (Prior Art)
Figure 17B:
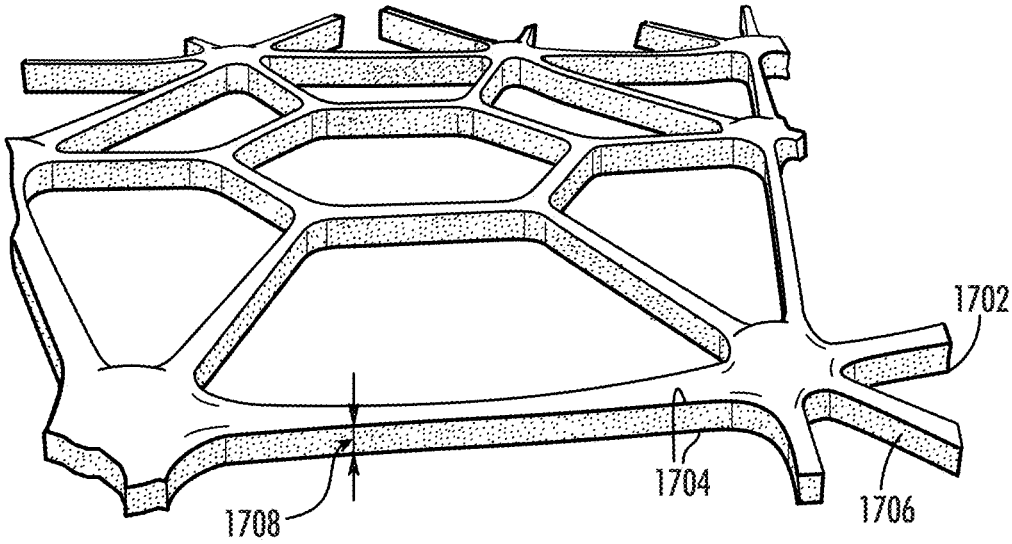
FIG. 17B illustrates an example of a triangle or triaxial geogrid with a plurality of strong axes and engineered pattern discontinuities with a compressible cellular layer, referred to herein as a compressible cellular core between two polymeric sheets.
Figure 17C:
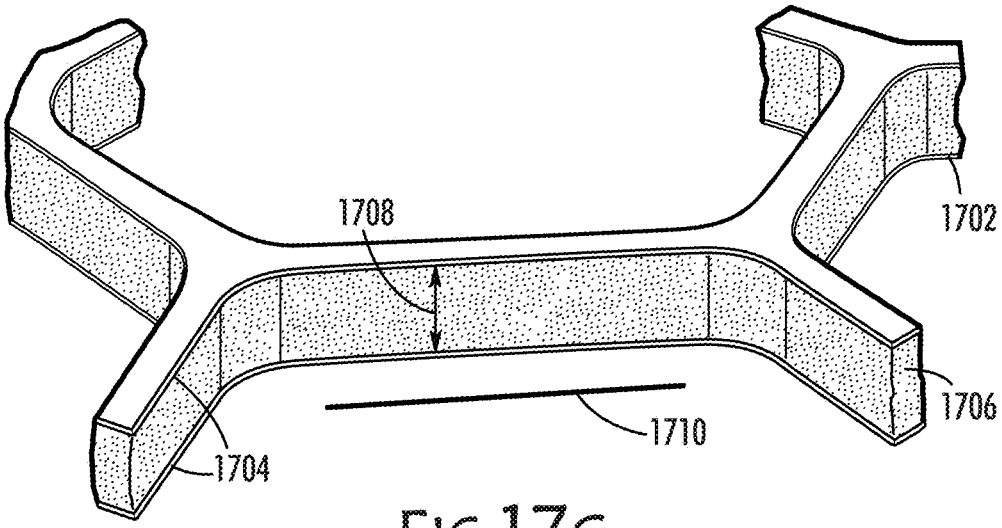
FIG. 17C illustrates an example of a triangle or triaxial geogrid with a plurality of strong axes and engineered pattern discontinuities with a compressible cellular layer, referred to herein as a compressible cellular core between two polymeric sheets, wherein the rib aspect ratio is depicted in comparison to a node aspect ratio.

Referring now to FIG. 17A (Prior Art), illustrating an example polymeric triaxial geogrid without patterned discontinuities or a compressible cellular layer 1700, and comparing to FIGS. 17B-C, an example horizontal multilayer mechanically stabilizing geogrid, also referred to as a triangle or triaxial geogrid, with patterned discontinuities and a plurality of strong axes 1702. In this example the polymeric material 1704 is on the top and the bottom of a compressible cellular layer 1706. Further, the high aspect ratio within the nodes of the hexagon provides greater lateral restraint to the geogrid, depicted more clearly in FIG. 17C as showing an arrow from the aspect ratio 1708 of the nodes to the ribs 1710. In one embodiment, the rib aspect ratio is lower than the node aspect ratio. In other embodiments the rib aspect ratio and the node aspect ratio are of similar height. In further embodiments, the hexagon within a hexagon geometry, created by patterned engineered discontinuity, provides a concave bowl or concave area. In the present example of FIG. 17C, the unique pattern with strong axes is defined by an outer hexagon node (larger, stronger nodes) that have a higher aspect ratio, and the inner hexagon nodes (increased pliability) that has a lower aspect ratio, thereby forming cups or bowls wherein aggregate can confine and lock into place. In this aspect, the confinement is increased and allows for use applications in a variety of substrates, while also maintaining rigidity through the polymeric top and bottom layer 1704. In such embodiments, the aggregate nests due to the void regions within the pattern. In even further embodiments, a dome shape may be enabled whereby the inner hexagon receives additional height through a compressible cellular layer 1706, such embodiments may be constructed through the co-extrusion process and allow for increased lateral restraint and rigidity from the polymeric backbone or structure of the hexagonal geogrid.

Figure 17D:
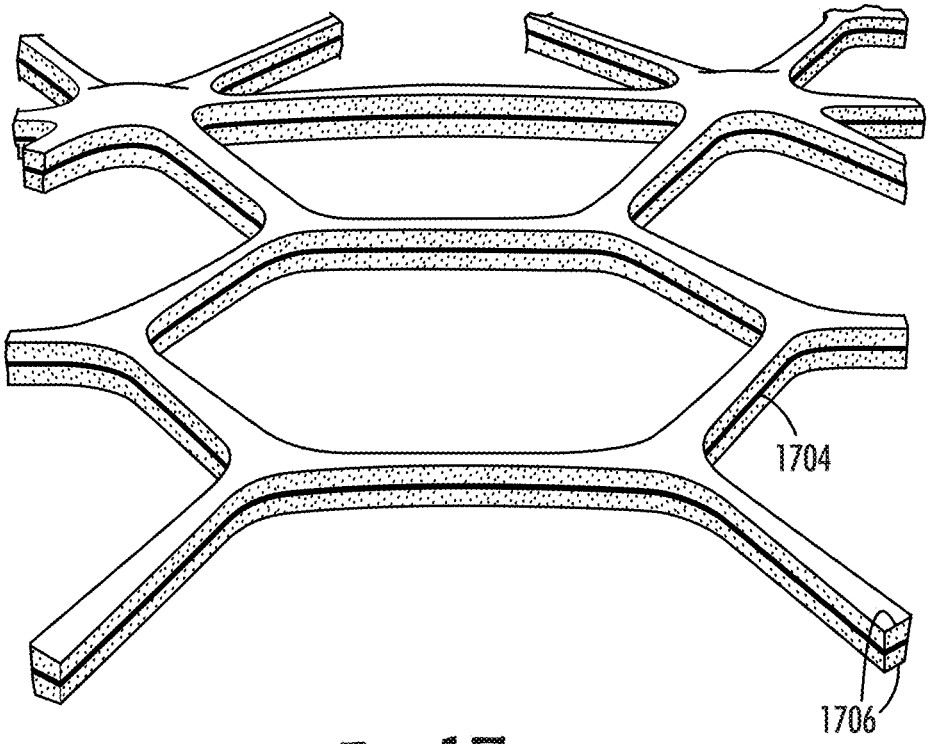
FIG. 17D illustrates an example of a triangle or triaxial geogrid with a plurality of strong axes and engineered pattern discontinuities with a compressible cellular layer, referred to herein as a compressible cellular cap on the top and bottom of a polymeric sheet.

Continuing with FIG. 17D, an additional embodiment with compressible caps, wherein the compressible cellular layer 1706 is on the top and bottom of the polymeric geogrid 1704, or the horizontal mechanically stabilized geogrid with a plurality of strong axes and patterned discontinuity. Similar to the compressible core of FIG. 17C, in FIG. 17D, the compressible cap creates a higher aspect ratio utilizing less polymeric material. In some examples, the compressible cap embodiment performs better as the surface roughness is built into the compressible cellular layer, and does not require further additives or manufacturing processes to create a rougher surface area or increase the surface area. Similarly, the compressible cap cellular layer may be an open or closed cellular layer, with the present example being a closed cell engineered foam, wherein the closed cells allow pockets of air to trap and further provide stabilization from lateral forces and trafficking.

Figure 18A:
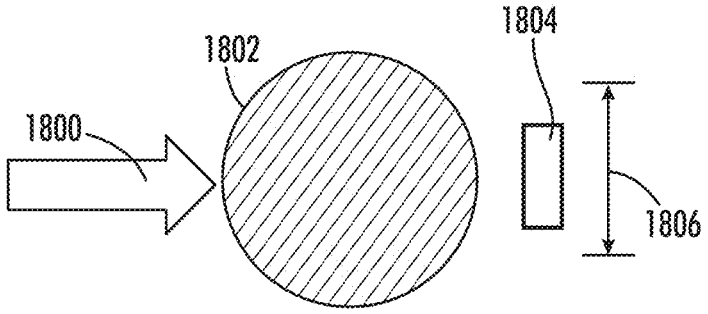
FIG. 18A illustrates an example of aggregate load moving horizontally across a triangle or triaxial geogrid with a plurality of strong axes and engineered pattern discontinuities with a compressible cellular layer.
Figure 18B:
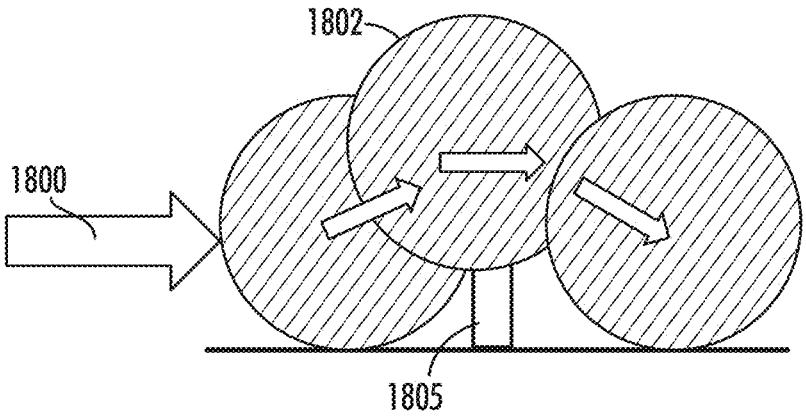
FIG. 18B is an illustration of an example polymeric triangle or triaxial geogrid depicting a lack of a compressible cellular layer, lacking "floating" ribs, that allow aggregate to move over the rib.

Referring now to FIGS. 18A-B, illustrating an example of aggregate load moving horizontally across a horizontal multilayer mechanically stabilizing geogrid. In the example, FIG. 18A discloses an example of the "floating rib" or rib 1804 of a geogrid with a compressible cellular layer, creating a heightened aspect ratio, and providing for aggregate 1802 to become laterally restrained 1806 due to the hydrophilic properties of the geometry and aspect ratio. Further, capillary forces within the soil or aggregate allow attraction, thereby the hydrophilic nature of some embodiments allows for attraction of the particles and retention. In the example, FIG. 18A, aggregate 1802 and soil is disclosed moving with horizontal force 1800 against a floating hexagon rib or rib 1804 of the hexagonal geometry in the horizontal multilayer mechanically stabilizing geogrid, thereby providing increased lateral restraint.

In the example of FIG. 18B, a polymeric geogrid is disclosed, without a compressible cellular layer. The polymeric geogrid lacks the buoyancy or floating aspect the compressible cellular layer has. The close celled compressible cellular layer FIG. 18A traps air within the cells, as well as provides hydrophobic response, that allows for floating. In comparison, the non-floating rib 1805 lacks air molecules and allows for horizontal load of soil and aggregate to traverse with less resistance.

Figure 19A:
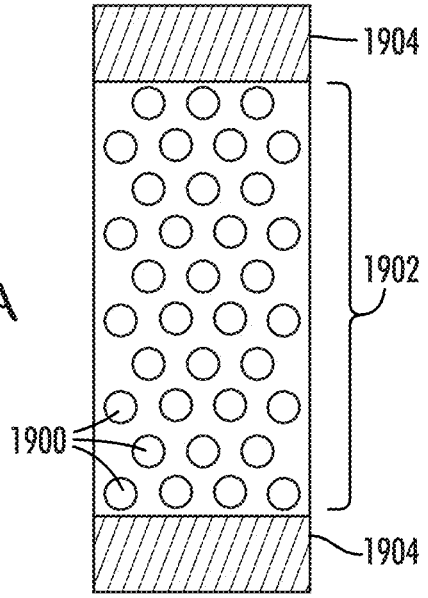
FIG. 19A-C illustrates an example of vertical compression of a triangle or triaxial geogrid with a plurality of strong axes and engineered pattern discontinuities with a compressible cellular layer, herein known as a compressible cellular core.
Figure 19B:
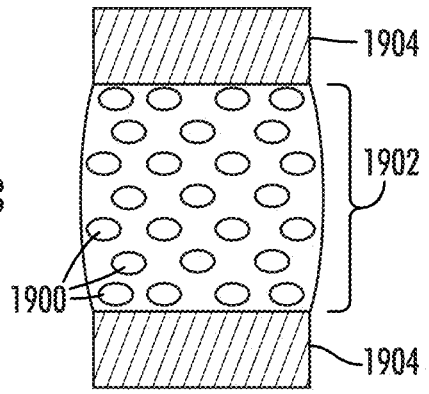
Figure 19C:
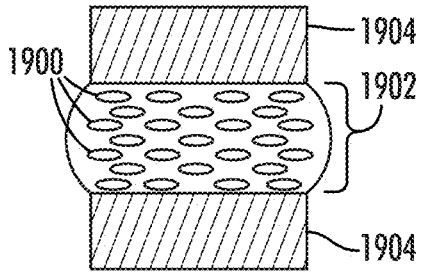

Referring now to FIGS. 19A-C, illustrating an example of the compression of a horizontal multilayer mechanically stabilizing geogrid with patterned engineered discontinuities and a plurality of strong axis that possess a core of a compressible cellular layer 1902. This example is referred to herein as a compressible core, but in other examples the same principles apply to the compressible cap. In the example, voids 1900 or pores or openings found within the compressible cellular layer provides pockets for aggregate confinement, as well as providing lateral restraint and compression resistance. In the example, FIG. 19A illustrates a polymeric material 1904 on the top and bottom of a compressible cellular layer, wherein compression has not occurred, and/or trafficking has not compressed the core cellular layer.

In the example, the polymeric material provides the rigidity and the stiffness while the compressible cellular core layer allows for heightened aspect ratio and reduced polymeric needs, amongst other benefits described herein. In FIG. 19B, as the load increases from trafficking or other forces, the compression of the system locks in or compresses the aggregate and soils, stabilizing the geotechnical environment and further providing lateral restraint and compaction properties. In areas with lower quality aggregate, or soils with poor conditions, the expanding compressible cellular layer aids in locking in and stabilizing micro and macro particles. In FIG. 19C, the system stops yielding or compressing under trafficking or other forces, as the voids 1900 are compressed and the density increases. The resulting action on the system provides a mechanism to lock in aggregate and increase the stabilization as loading or trafficking incurs.

Figure 20A:
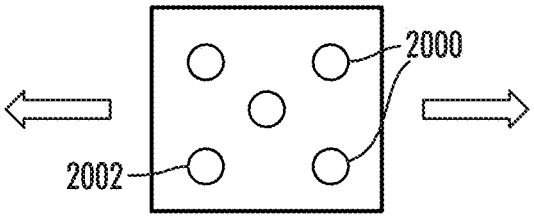
FIGS. 20A-C illustrates an example of the voids being created by lateral forces on the compressible cellular layer, or compressible cellular core, of a triangle or triaxial geogrid with a plurality of strong axes and engineered pattern discontinuities.
Figure 20B:
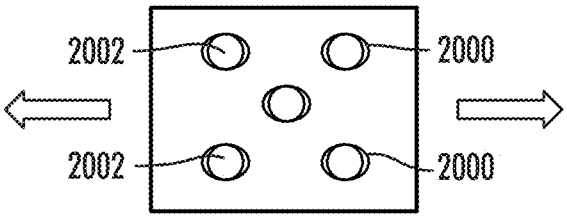
Figure 20C:
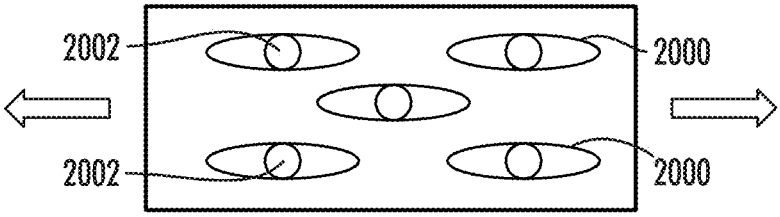

Referring now to FIGS. 20A-C, illustrating an example of the voids 2000 within the compressible cellular layer of a horizontal multilayer mechanically stabilizing geogrid. Additives such as calcium carbonate $CaCO_3$ or fly ash 2002 may be added to change the roughness of the material and to fill voids with a stiffening agent. In the example, the stiffening may derive from particles that allow the compressible cellular layer to develop additional rigidity. In doing so, in some embodiments, as the rigidity of the compressible cellular layer increases, the compressibility decreases. Therefore, increasing the amount of trafficking cycles before failure.

Figure 21A:
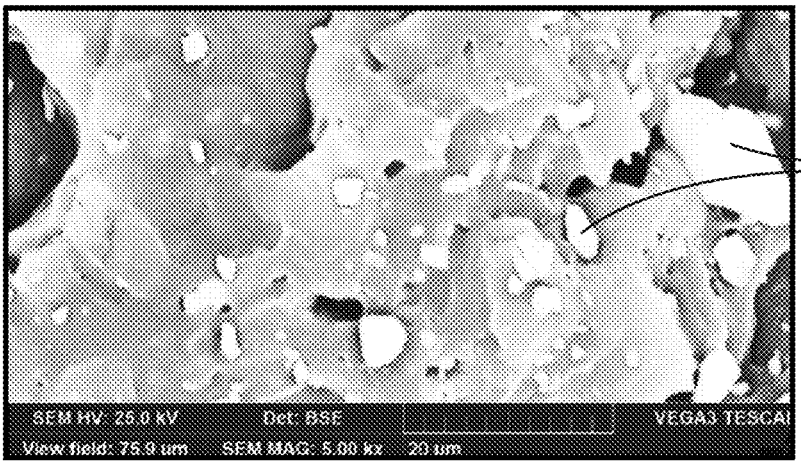
FIG. 21A illustrates an example of an enhanced image of a compressible cellular layer with additives twice the surface energy of that of polymeric material in a section of a triangle or triaxial geogrid with a plurality of strong axes and engineered pattern discontinuities with a compressible cellular layer.
Figure 21B:
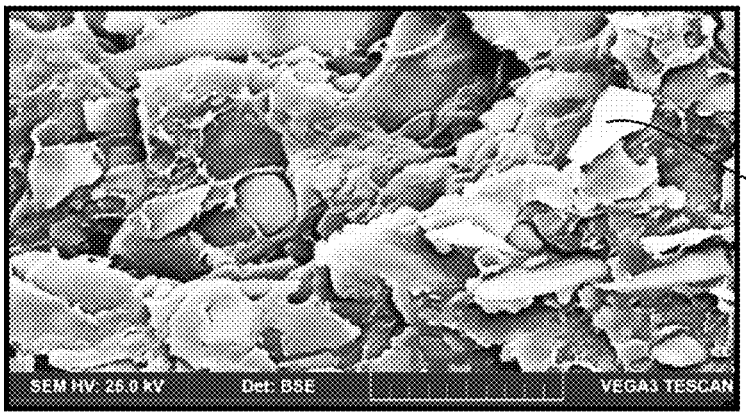
FIG. 21B illustrates an example of an enhanced image of a compressible cellular layer with additives with a similar surface energy as the polymeric material in a section of a triangle or triaxial geogrid with a plurality of strong axes and engineered pattern discontinuities with a compressible cellular layer.

Referring now to FIGS. 21A-B, illustrating an example of an enhanced image of a compressible cellular layer with additives 2100 in a horizontal multilayer mechanically stabilizing geogrid with patterned discontinuities and a plurality of strong axes. In the example of FIG. 21A, the additives 2100 are depicted as having twice the surface energy of that of polypropylene. In FIG. 21B, the additives 2102 have equal surface energy to that of polypropylene. Additives allow for and provide roughness which in turn increases the surface area and the ability of a cellular layer and/or polymeric material to increase friction with a geotechnical environment, such as an environment with a geogrid, soils, and aggregate.

In one example, diatomaceous earth (DE) is added to the surface of a compressible cellular layer, wherein the surface roughness is increased with little addition of weight. Further, DE also absorbs water or moisture (DE has physisorption properties) within the environment, activating capillary forces within the soil and aggregate as well as preventing repulsion from polymeric materials with hydrophobic properties. In another example, DE may also be used as a filler for the compressible cellular layer wherein properties such as roughness, porosity and water absorption provide beneficial characteristics for aggregate stabilization. In even further aspects, DE also absorbs heavy metals (such as AL, Ba, Cd, Cr, Cu, Fe, Pb, Mn, Ni, and Zn), and therefore provides an ecological benefit when applied in geotechnical engineering projects such as under pavement and where concentrations from emissions may cause ecological harm.

In other aspects, a polylactic acid (PLA) may be used, wherein it slowly dissolves over time within the soil environment, namely due to moisture or water content, causing aggregate to settle and conform and further nest the aggregate. In one aspect, the PLA dissolves in an irregular formation on the surface of the cellular layer, thereby increasing surface roughness and surface energy, as well as surface area and friction. In another aspect, PLA is added to the surface of a polymeric material, adding surface roughness and friction in contact with the surrounding geotechnical environment.

Figure 22:
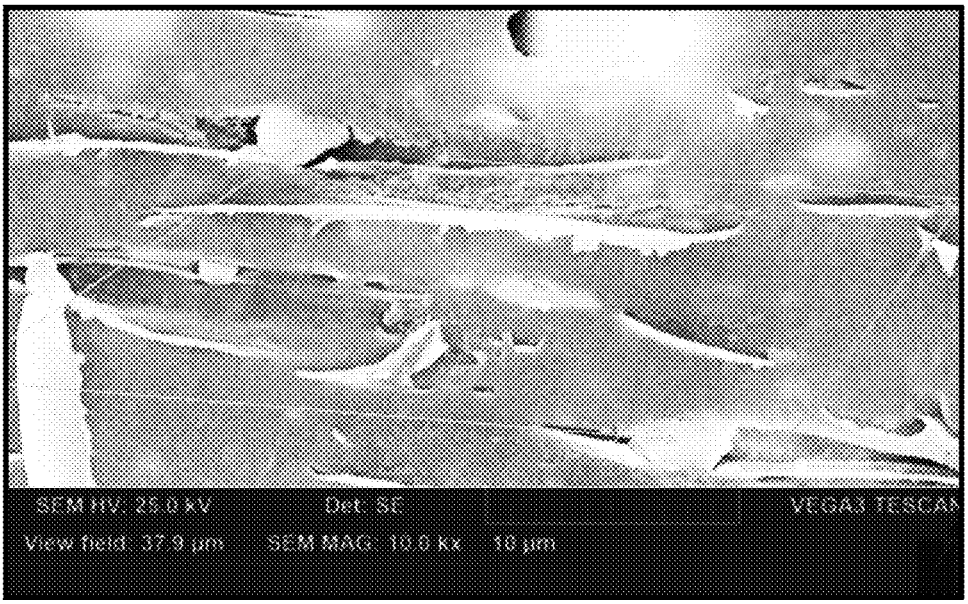
FIG. 22 illustrates an additional example of an enhanced image of a compressible cellular layer with additives in a section of a triangle or triaxial geogrid with a plurality of strong axes and engineered pattern discontinuities with a compressible cellular layer.

Referring now FIG. 22, illustrating an additional example of an enhanced image of a compressible cellular layer with additives in a horizontal multilayer mechanically stabilizing geogrid with patterned engineered discontinuities. In one aspect, the modifier particles or additives, allow for increase in surface roughness therefore increasing surface area and surface contact with the substrate. Examples of additives may include $CaCO_3$ (calcium carbonate), hydrous magnesium silicates (talc), $CaSiO_3$ (wollastonite), calcium sulfate (gypsum), diatomaceous earth, titanium dioxide, nano-fillers (such as nano clay), multi-wall carbon nanotube, single carbon wall carbon nanotube, natural or synthetic fibers, metal fibers, glass fibers, dolomite, silica, mica, and aluminum hydrate.

In FIG. 22, the voids are highlighted and the modifier particles or additives are shown interlocking and embedded within the voids of a cellular layer. The porosity of the cellular layer, along with the hydrophilic properties, in some aspects, increases soil adhesion and stabilization. In other aspects, the foaming agents that comprise the cellular layer, having porosity that contains voids with additives is disclosed, wherein the additives increase roughness and decrease compressibility in the cellular layer, acting as a stiffening agent. In other embodiments, the additives are on the exterior of the cellular layer and do not form a stiffening agent, but serve to increase roughness. The various aspects are relative to the geotechnical environment, and one skilled in the art, through this disclosure, will see the benefits of additives or other materials to the cellular layer over that of prior art.

Figure 23A:
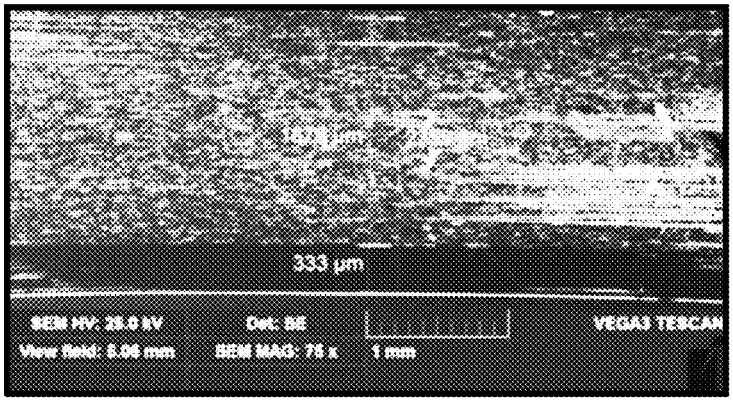
FIGS. 23A-B illustrates an example of an enhanced image of a rib section of a triangle or triaxial geogrid with a plurality of strong axes and engineered pattern discontinuities with a compressible cellular layer, referred to herein as a compressible cellular core in both stretched form (A) and collapsed/crushed form (B)
Figure 23B:
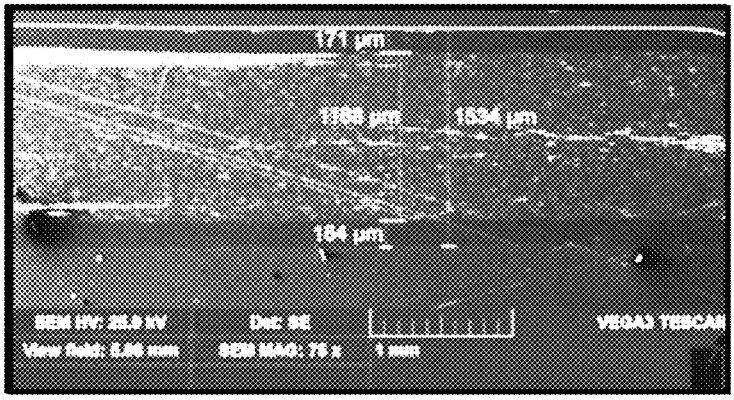

Referring now to FIGS. 23A-B, illustrating an example of an enhanced image of a rib section of a horizontal mechanically stabilized geogrid, one with a compressible cellular layer (FIG. 23A), and one with only a polymeric structure (FIG. 23B), in both stretched form and compressed form. In FIGS. 23A-B, the example horizontal mechanically stabilized multilayer geogrid is illustrated in a manufactured state and in a state under load (as would be seen in trafficking tests). The voids in the cellular layer in the manufacture stated are illustrated and the numerosity depends upon the foaming agent or material used to form the cellular layer, in one aspect $CaCO_3$ is utilized. Under load, the horizontal mechanically stabilized geogrid compresses and locks in aggregate, in this example the height aspect is compressed from 2.4 mm to 1.5 mm, indicating a compression of 0.9 mm, further providing lateral restraint and aggregate stabilization.

Figure 24B:
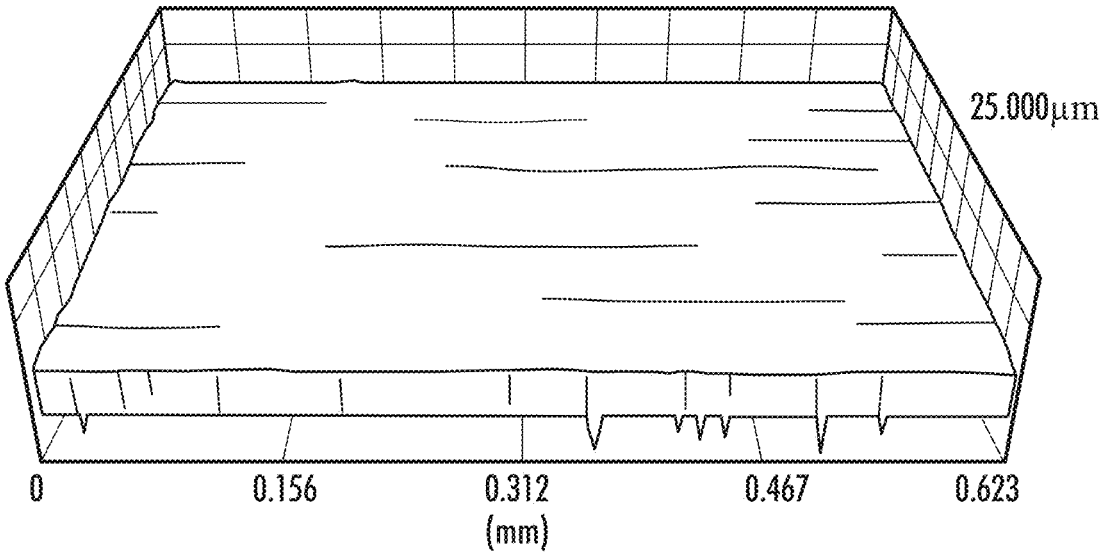

Referring now to FIGS. 24A-B, illustrating an example of a microscopic comparison between a polymeric surface (FIG. 24B) and a compressible cellular layer surface (FIG. 24A), illustrating the increased roughness from the compressible cellular layer. An example of microscopic evaluation of surface roughness on the compressible cellular layer is illustrated and, as previously discussed, provides a greater surface area to contact with aggregates and soil. Such interactions include micro particles as well as provides friction and lateral restraint against shifting soils and aggregate. Lateral restraint is a key measurement and often a result of trafficking, by adding a compressible cellular layer to the geogrid, the surface roughness, and increase in surface area, has shown surprising results in restraining soils and compaction occurs.

Further, in FIGS. 24A-B, the compressible cellular layers (FIG. 24A) provide distinct advantages over polymeric material with a smooth surface finish (FIG. 24B), allowing for the compressibility, the hydrophilic properties, and increased surface roughness/area. In one aspect, the polymeric material may form striations or long grooves or channels that lack resistance and may increase compaction and failure. In another aspect, the compressible cellular layer may have a surface that forms irregular patterns and provides friction and restraint of movement geogrid across the surface. In yet another aspect, the compressible cellular layer may increase aspect ratio that allows for greater interaction with the hydrophilic properties and additives.

Figure 25A:
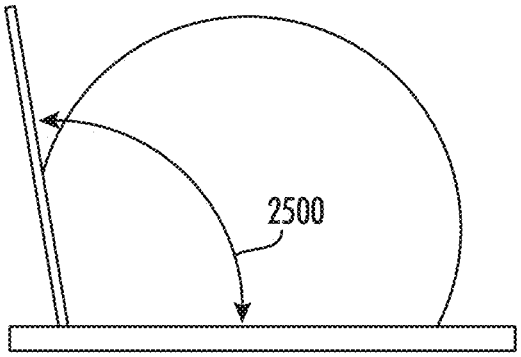
FIGS. 25A-B illustrates an example of contact angle versus surface energy measurements for a triangle or triaxial geometry geogrid with high surface energy from the compressible cellular layer versus a low surface energy of a traditional polymeric geogrid.
Figure 25B:
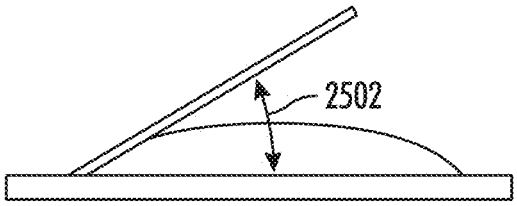
FIG.25B PRIOR ART

Referring now to FIGS. 25A-B, illustrating an example of contact angle versus surface energy measurements for a triangle or triaxial geometry geogrid and patterned discontinuities with high surface energy from the compressible cellular layer versus a low surface energy of a traditional polymeric geogrid. In one aspect, the polymeric material, and the hydrophobic qualities, produce low surface energy which reduces soil adhesion. Soil adhesion is the force responsible for the attraction between water and that of solid surfaces (such as polymeric material like polypropylene). Adhesion is responsible for allowing water to "stick" to materials. Further, water exhibits a property of surface tension, since water molecules are more attracted to other water molecules, as opposed to air. Water surfaces behave like films or layers, and adhere to one another.

In the examples of FIGS. 25A-B, a high surface energy, characterized by that of a compressible cellular layer, allows for soil adhesion and therefore soil attraction. Further, in some aspects, the compressible cellular layer is comprised of hydrophilic material, such as CaCO3, and thereby displays both adhesion and surface tension, thereby attracting the soil and aggregate particles and providing increased stabilization. A high contact angle 2500, as would be found in polymeric materials, glass, stainless steel, to name a few, results in low surface energy and non-stick properties. Whereas, the benefits of the disclosure herein indicate the compressible cellular layer of the horizontal mechanically stabilized geogrid may have a low contact angle, 2502 and high surface energy, displaying poor release properties and creating adhesion between the soil and the cellular layer.

Figure 26:
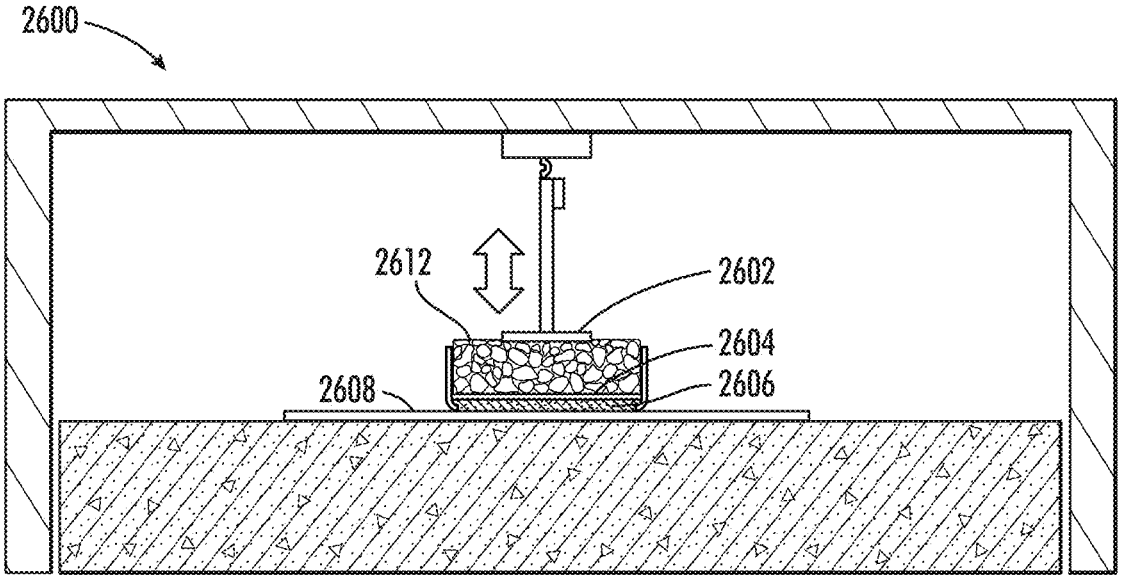
FIG. 26 illustrating an example of a Plate Load Test Rig (PLTR), used to measure the displacement of the various geogrid embodiments, in particular hard foam and soft foam.

Referring now to FIG. 26, an example of a Plate Load Test Rig ("PLTR") 2600, used to measure displacement of the various embodiments and specimens, in particular testing the differences between a hard foam and soft foam 2606 in a compressible cellular layer. In the PLTR test, a geogrid specimen 2604 is layered between a 4-inch layer of aggregate 2612 and a layer of foam 2606, with a steel plate 2602 being located beneath the foam layer 2606. To determine the compressibility of a geogrid embodiment or specimen 2604, a 1,000 lb force is imparted over 10 cycles to the aggregate/integral geogrid/foam stack. The geogrid embodiment or specimen is then removed from the apparatus and examined for rib compressibility and surface damage. From the tests using the PLTR apparatus 2600 shown in FIG. 26, the average displacement of various geogrid specimens can be determined, along with the varying properties a given foam produces.

II. EMBODIMENTS

Certain implementations of systems and methods consistent with the present disclosure are provided as follows:

Implementation 1. A geogrid system for improving substrate interactions within a geotechnical environment, comprising: a geotechnical environment; a substantially planar geogrid, comprising: a plurality of strong axis ribs and nodes; a patterned structure of engineered discontinuities to enhance substrate compaction and increase out-of-planar stiffness; and a compressible cellular layer that increases geogrid aspect ratio.

Implementation 2. The geogrid system of implementation 1, wherein the plurality of strong axis ribs are of a triangle or triaxial geometry.

Implementation 3. The geogrid system of implementation 1, wherein the plurality of strong axis ribs are of a rectangular geometry.

Implementation 4. The geogrid system of implementation 1, wherein the patterned structure of engineered discontinuities forms a hexagon pattern.

Implementation 5. The geogrid system of implementation 4, wherein the hexagonal structure comprises nested hexagons, including an inner hexagon and an outer hexagon structure.

Implementation 6. The geogrid system of implementation 5, wherein intersecting ribs of the nested hexagons are of varying aspect ratio, wherein the nodes have an increased aspect ratio compared the ribs.

Implementation 7. The geogrid system of implementation 1, wherein the plurality of strong axis ribs have an aspect ratio greater than 1.0.

Implementation 8. The geogrid system of implementation 1, where in the plurality of strong axis ribs are a multilayered structure.

Implementation 9. The geogrid system of implementation 8, wherein the multilayered structure comprises a core of polymeric material, and at least one compressible cellular layer configured to the core of polymeric material.

Implementation 10. The geogrid system of implementation 8, wherein the multilayered structure comprises a core comprising a compressible cellular layer and on a top and/or bottom surface of the core a layer of polymeric material.

Implementation 11. The geogrid system of implementation 8, wherein the multilayered structure is co-extruded.

Implementation 12. A geogrid system for improving substrate interactions within a geotechnical environment, comprising: a geotechnical environment; and a horizontal multilayer mechanically stabilizing geogrid, comprising: a geogrid with nodes and ribs, the geogrid comprising patterned discontinuities and a plurality of strong axis ribs; a core comprising a polymeric material; and on a top and/or a bottom surface of the core, having a compressible cellular layer.

Implementation 13. The geogrid system of implementation 12, wherein the core of the polymeric material is solid and rigid.

Implementation 14. The geogrid system of implementation 12, wherein the compressible cellular layer decreases quantity requirements of the polymeric material.

Implementation 15. The geogrid system of implementation 12, wherein horizontal multilayer mechanically stabilizing geogrid is configured with a patterned structure of engineered discontinuities to enhance substrate compaction and increase out-of-planar system stiffness.

Implementation 16. The geogrid system of implementation 15, wherein the patterned structure of engineered discontinuities forms a hexagon pattern.

Implementation 17. The geogrid system of implementation 16, wherein the hexagon pattern comprises nested hexagons, including an inner hexagon and an outer hexagon pattern.

Implementation 18. The geogrid system of implementation 17, wherein intersecting ribs of the nested hexagons are of varying aspect ratio.

Implementation 19. The geogrid system of implementation 12, wherein the horizontal multilayer mechanically stabilizing geogrid is formed from layers of different materials and in a co-extrusion.

Implementation 20. The geogrid system of implementation 12, wherein the horizontal multilayer mechanically stabilizing geogrid is formed of three or more layers.

Implementation 21. The geogrid system of implementation 12, wherein the compressible cellular layer increases aspect ratio of the geogrid at intersecting ribs.

Implementation 22. The geogrid system of implementation 12, further comprising particle stabilization enhancement provided by the compressible cellular layer allowing for increased compaction in the geotechnical environment.

Implementation 23. The geogrid system of implementation 12, wherein the compressible cellular layer is configured to impede lateral aggregate or soil flow by trapping contents by increasing the interaction between the geogrid and the geotechnical substrate.

Implementation 24. The geogrid system of implementation 12, wherein the compressible cellular layer is configured with void-containing regions wherein surface area is increased allowing for increased soil retention therein.

Implementation 25. The geogrid system of implementation 12, wherein the horizontal multilayer mechanically stabilizing geogrid is comprised of triaxial and/or triangle geometry of strong ribs.

Implementation 26. The geogrid system of implementation 12, wherein the geogrid is comprised of a rectangular geometry of strong ribs.

Implementation 27. The geogrid system of implementation 12, wherein the compressible cellular layer comprises a particulate material.

Implementation 28. The geogrid system of implementation 27, wherein the particulate material is calcium carbonate.

Implementation 29. The geogrid system of implementation 12, wherein the compressible cellular layer comprises an engineered foaming agent.

Implementation 30. A geogrid system for improving substrate interactions within a geotechnical environment, comprising: a geotechnical environment; a horizontal multilayer mechanically stabilizing geogrid, comprising: a core comprising a compressible cellular layer that increases aspect ratio of the horizontal multilayer mechanically stabilizing geogrid; and a top and bottom surface of the core comprising a layer of polymeric material.

Implementation 31. The geogrid system of implementation 30, wherein the layer of polymeric material is solid and rigid.

Implementation 32. The geogrid system of implementation 30, wherein the compressible cellular layer decreases quantity requirements of the polymeric material.

Implementation 33. The geogrid system of implementation 30, wherein the geogrid is configured with a patterned structure of engineered discontinuities to enhance substrate compaction and increase out-of-planar system stiffness.

Implementation 34. The geogrid system of implementation 33, wherein the discontinuities forms a hexagon pattern.

Implementation 35. The geogrid system of implementation 34, wherein the hexagon pattern comprises nested hexagons, including an inner hexagon and an outer hexagon structure.

Implementation 36. The geogrid system of implementation 35, wherein intersecting ribs of the nested hexagons are of varying aspect ratio.

Implementation 37. The geogrid system of implementation 30, wherein the horizontal multilayer mechanically stabilizing geogrid is formed from layers of different materials and in a co-extrusion.

Implementation 38. The geogrid system of implementation 30, wherein the horizontal multilayer mechanically stabilizing geogrid is formed of three or more layers.

Implementation 39. The geogrid system of implementation 30, wherein the compressible cellular layer increases the aspect ratio of the geogrid at intersecting ribs.

Implementation 40. The geogrid system of implementation 30, further comprising particle stabilization enhancement provided by the compressible cellular layer allowing for increased compaction in the geotechnical environment.

Implementation 41. The geogrid system of implementation 30, wherein the compressible cellular layer is configured to restrain lateral aggregate or soil flow by trapping contents by increasing the interaction between the horizontal mechanically stabilizing geogrid and the geotechnical environment.

Implementation 42. The geogrid system of implementation 30, wherein the compressible cellular layer is configured with void-containing regions wherein surface area is increased allowing for increased soil retention therein.

Implementation 43. The geogrid system of implementation 30, wherein the horizontal multilayer mechanically stabilizing geogrid is comprised of a triangle geometry of strong axis ribs.

Implementation 44. The geogrid system of implementation 30, wherein the horizontal multilayer mechanically stabilizing geogrid is comprised of a rectangular geometry of strong axis ribs.

Implementation 45. The geogrid system of implementation 30, wherein the compressible cellular layer comprises a particulate material.

Implementation 46. The geogrid system of implementation 45, wherein the particulate material is calcium carbonate.

Implementation 47. The geogrid system of implementation 38, wherein at least one compressible cellular layer comprises an engineered foaming agent.

Implementation 48. A method for improving geotechnical environments with a horizontal multilayer mechanically stabilizing geogrid, comprising: applying a geogrid with a plurality of strong axes, patterned discontinuities, and a compressible cellular layer with heightened aspect ratio to a geotechnical environment; wherein applying places the geogrid into aggregate and soil; reducing lateral movement of the aggregate and soil within the geotechnical environment; and increasing, by the geogrid, lifetime cycles of trafficking over the geotechnical environment.

Implementation 49. The method of implementation 48, further comprising interacting, by the compressible cellular layer, wherein interacting is a macro interaction due to increase in aspect ratio of ribs of the geogrid.

Implementation 50. The method of implementation 48, further comprising interacting, by the compressible cellular layer, wherein interacting is a micro interaction due to a multilayer construction allowing for nesting of aggregate particles.

Implementation 51. The method of implementation 48, wherein increasing the lifetime cycles increases the lifetime cycles of trafficking in accordance with equivalent single axle load (ESAL) standard.

For the purposes of this specification and the appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the claims.

Therefore, the following is claimed:

1. A geogrid system for improving substrate interactions within a geotechnical environment, comprising:

a horizontal multilayer mechanically stabilizing geogrid, comprising:

(i) a patterned structure of engineered discontinuities comprising non-continuous ribs that terminate at secondary nodes, and primary nodes that form a strong axis, wherein the non-continuous ribs and the strong axis enhance substrate compaction and increase out-of-planar stiffness;

(ii) a core layer comprising a void-containing compressible cellular layer that increases aspect ratio and surface area of the horizontal multilayer mechanically stabilizing geogrid, and wherein the aspect ratio of the horizontal mechanically stabilizing geogrid is larger at the primary nodes than at the secondary nodes; and (iii) a top and bottom surface layer comprising a layer of polymeric material.

2. The geogrid system of claim 1, wherein the top and bottom layer of polymeric material is rigid polyethylene or polypropylene.

3. The geogrid system of claim 1, wherein the core layer comprising the compressible cellular layer decreases quantity requirements of polymeric material for the top and bottom surface layer.

4. The geogrid system of claim 1, wherein the patterned structure of engineered discontinuities forms a hexagon pattern.

5. The geogrid system of claim 4, wherein the hexagon pattern comprises nested hexagons, including an inner hexagon and an outer hexagon structure.

6. The geogrid system of claim 5, wherein intersecting ribs of the nested hexagons are of varying aspect ratio.

7. The geogrid system of claim 1, wherein the horizontal multilayer mechanically stabilizing geogrid is formed from layers of different materials co-extrusion.

8. The geogrid system of claim 1, wherein the horizontal multilayer mechanically stabilizing geogrid is formed of three or more layers.

9. The geogrid system of claim 8, wherein at least one layer of the three or more layers of the horizontal mechanically stabilizing geogrid is a void-containing compressible cellular layer that comprises an engineered foaming agent.

10. The geogrid system of claim 1, wherein the core layer comprising the void containing compressible cellular layer, is configured with 25 percent by volume of void-containing regions wherein surface area is increased allowing for increased soil retention therein.

11. The geogrid system of claim 1, wherein the core layer comprising the void-containing compressible cellular layer comprises a particulate material.

12. The geogrid system of claim 11, wherein the particulate material is calcium carbonate.

13. A method for improving geotechnical environments with a horizontal multilayer mechanically stabilizing geogrid, comprising:

applying to a geotechnical environment a geogrid with a plurality of strong axes comprised of primary nodes, patterned discontinuities of non-continuous ribs that terminate at secondary nodes, a top and bottom surface layer comprising a layer of polymeric material, and a compressible cellular layer with heightened aspect ratio, and wherein the aspect ratio of the horizontal mechanically stabilizing geogrid is larger at the primary nodes than at the secondary nodes, and wherein applying places the geogrid into aggregate and soil;

reducing lateral movement of the aggregate and soil within the geotechnical environment through the aggregate interacting with the patterned discontinuities of the non-continuous ribs that terminate at the secondary nodes and the plurality of strong axes comprised of the primary nodes; and increasing, by the geogrid, lifetime cycles of trafficking over the geotechnical environment.

14. The method of claim 13, further comprising interacting, by the compressible cellular layer, wherein interacting is a macro interaction due to an increase in aspect ratio of ribs of the geogrid.

15. The method of claim 13, further comprising interacting, by the compressible cellular layer, wherein interacting is a micro interaction due to a multilayer construction allowing for nesting of aggregate particles.

16. The method of claim 13, further comprising particle stabilization enhancement provided by the compressible cellular layer allowing for increased compaction in the geotechnical environment.

17. The method of claim 13, wherein the compressible cellular layer is configured to restrain lateral forces against the aggregate and soil by trapping contents by increasing interaction between the horizontal mechanically stabilizing geogrid and the geotechnical environment.

* * * * *